US011538448B1

(12) United States Patent
Antoun

(10) Patent No.: US 11,538,448 B1
(45) Date of Patent: Dec. 27, 2022

(54) COCKTAIL DRUM

(71) Applicant: Ramy Antoun, Spicewood, TX (US)

(72) Inventor: Ramy Antoun, Spicewood, TX (US)

( * ) Notice: Subject to any disclaimer, the term of this patent is extended or adjusted under 35 U.S.C. 154(b) by 1 day.

(21) Appl. No.: 17/150,810

(22) Filed: Jan. 15, 2021

Related U.S. Application Data

(60) Provisional application No. 62/961,637, filed on Jan. 15, 2020.

(51) Int. Cl.
*G10D 13/02* (2020.01)
*G10D 13/10* (2020.01)

(52) U.S. Cl.
CPC ..... *G10D 13/28* (2020.02); *G10D 13/02* (2013.01)

(58) Field of Classification Search
CPC ..... G10D 13/28; G10D 13/02; G10D 13/02; G10D 13/00
See application file for complete search history.

(56) References Cited

U.S. PATENT DOCUMENTS 9,390,693 B2 * 7/2016 Kasha ..... G10D 13/20

* cited by examiner

*Primary Examiner* — Kimberly R Lockett

(57) ABSTRACT

Particular embodiments described herein provide for a cocktail drum basket. The cocktail drum basket can include a lower cocktail basket portion, where the lower cocktail basket portion is supported by a rim of a first drum and an upper cocktail basket portion, where the upper cocktail basket portion supports a second drum over the first drum. The cocktail drum basket can be used to position a second drum over a first drum in a three-dimensional (3D) plane using the cocktail drum basket to position the second drum along an X-axis, a Y-axis, and a Z-axis relative to the first drum.

20 Claims, 18 Drawing Sheets

COCKTAIL DRUM

CROSS-REFERENCE TO RELATED APPLICATIONS

This disclosure relates to Provisional Application No. 62/961,637, entitled "DRUM COCKTAIL" filed in the US Patent Office on Jan. 15, 2020, which is hereby incorporated by reference in its entirety.

TECHNICAL FIELD

This disclosure relates in general to the field of music instruments, and more particularly, to a cocktail drum.

BACKGROUND

The drum is a member of the percussion group of musical instruments and in the Hornbostel-Sachs classification system, it is considered a membranophone. Generally, drums typically consist of at least one membrane often called a drumhead or drum skin, that is stretched over a shell. The drumhead is struck either directly with the player's hands or with a device to produce sound. Drums are the world's oldest musical instruments and the basic design has remained virtually unchanged for thousands of years.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

Figure 1A:
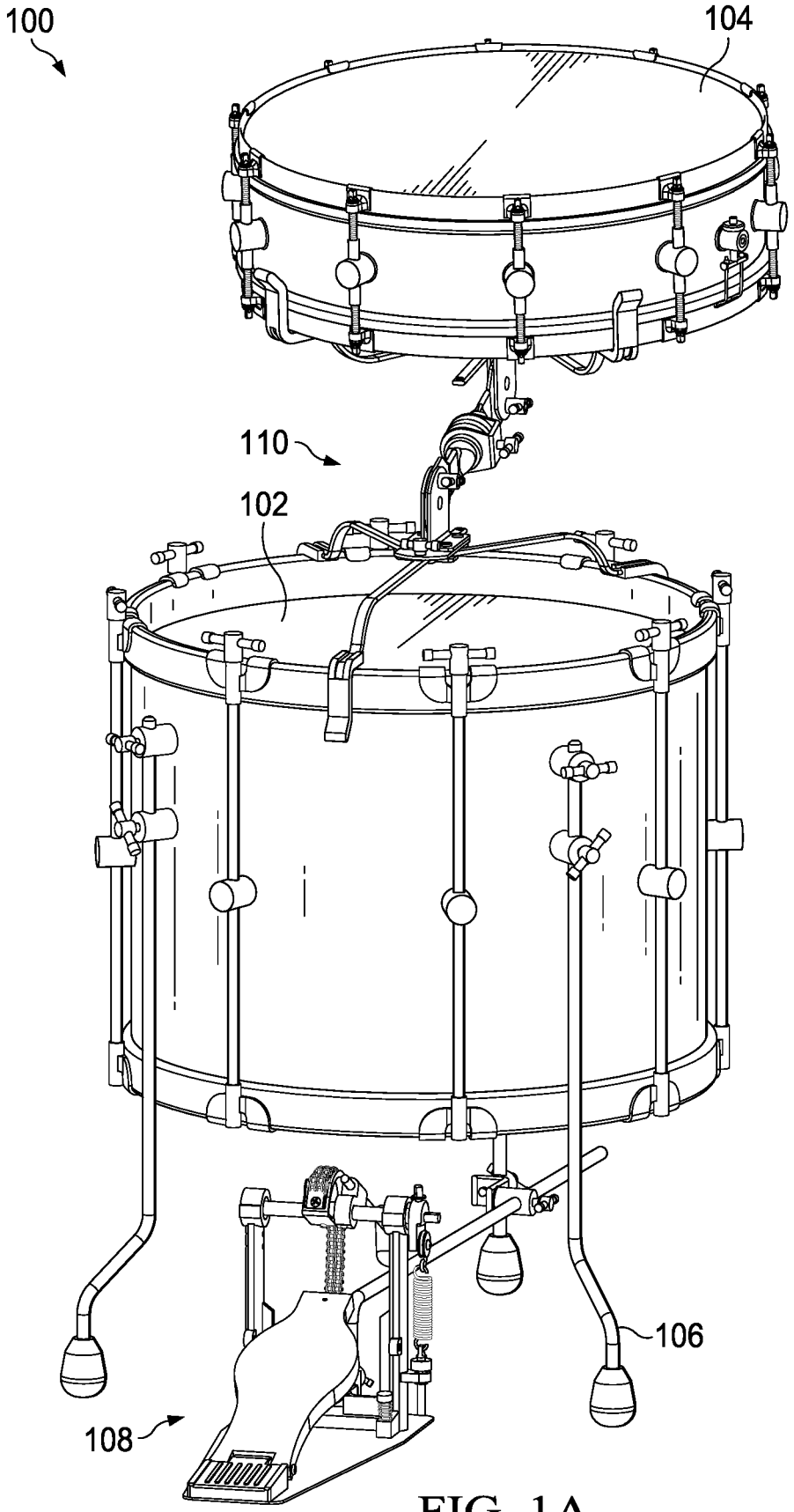
FIG. 1A is a simplified perspective view diagram of a cocktail drum, in accordance with an embodiment of the present disclosure.

The FIGURES of the drawings are not necessarily drawn to scale, as their dimensions can be varied considerably without departing from the scope of the present disclosure.

DETAILED DESCRIPTION

Example Embodiments

The following detailed description sets forth examples of apparatuses, methods, and systems relating to a system for enabling a cocktail drum in accordance with an embodiment of the present disclosure. Features such as structure(s), function(s), and/or characteristic(s), for example, are described with reference to one embodiment as a matter of convenience; various embodiments may be implemented with any suitable one or more of the described features.

In the following description, various aspects of the illustrative implementations will be described using terms commonly employed by those skilled in the art to convey the substance of their work to others skilled in the art. However, it will be apparent to those skilled in the art that the embodiments disclosed herein may be practiced with only some of the described aspects. For purposes of explanation, specific numbers, materials, and configurations are set forth in order to provide a thorough understanding of the illustrative implementations. However, it will be apparent to one skilled in the art that the embodiments disclosed herein may be practiced without the specific details. In other instances, well-known features are omitted or simplified in order not to obscure the illustrative implementations.

The terms "over," "under," "below," "between," and "on" as used herein refer to a relative position of one layer or component with respect to other layers or components. For example, one component disposed over or under another component may be directly in contact with the other component or may have one or more intervening components. Moreover, one component disposed between two components may be directly in contact with the two components or may have one or more intervening components. In contrast, a first component "directly on" a second component is in direct contact with that second component. Similarly, unless explicitly stated otherwise, one feature disposed between two features may be in direct contact with the adjacent features or may have one or more intervening features.

In the following detailed description, reference is made to the accompanying drawings that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense. For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

The term "coupled with," along with its derivatives, may be used herein. The term "coupled" may mean one or more of the following. The term "coupled" may mean that two or more elements are in direct physical contact. However, the term "coupled" may also mean that two or more elements indirectly contact each other, but yet still cooperate or interact with each other, and may mean that one or more other elements are coupled or connected between the elements that are said to be coupled with each other. The term "directly coupled" means that two or more elements are in direct contact. The term "about" indicates a tolerance of five percent (5%). For example, about forty-five degrees(45°) would include forty-five degrees(45°) and ±2.25 degrees (2.25°) from forty-five degrees (45°).

FIG. 1A is a simplified view of a cocktail drum kit 100. In an example, cocktail drum kit 100 can include a first drum 102, a second drum 104, and a cocktail basket 110. First drum 102 can be a drum, especially a base drum, floor tom drum, or some other type of percussive instrument other than a drum. Second drum 104 can be a drum, especially a snare drum, or some other type of percussive instrument other than a drum. First drum can include legs 106. Legs 106 support first drum 102 and raise first drum 102 off of the floor. In example, cocktail drum kit 100 can also include a pedal 108 or pedal 108 may be separate from cocktail drum kit 100. Pedal can be coupled to one or more legs 106 of first drum 102.

Cocktail basket 110 can support second drum 104 over first drum 102. Cocktail basket 110 can be coupled to first drum 102 and second drum 104. More specifically, as illustrate in FIG. 1A, cocktail basket 110 can be coupled to the top rim or outside edge of first drum 102 and can be coupled to the bottom rim or outside edge of second drum 104. It is worth noting that cocktail basket 110 is not secured or fixed to the outside of first drum 102 but sits on or is coupled to the top rim of first drum 102. In addition, cocktail basket 110 can allow second drum 104 to be moved along all three X, Y, and Z axes relative to first drum 102 and help secure second drum 104 in a desired position relative to first drum 102 in a three-dimensional (3D) plane.

The X, Y, and Z axes are axis of a cartesian coordinate system for a three-dimensional space that consists of an ordered triplet of lines (the axes) that go through a common point (the origin) and are pair-wise perpendicular. If the common point is the center of first drum 102, using cocktail basket 110, second drum 104 can be vertically moved along the Y-axis, horizontally the X-axis, and depth wise or closer or further away from the user along the Z-axis, Cocktail basket 110 allows a user to position second drum 104 to a desired location along all three X, Y, and Z axes relative to first drum 102.

Figure 1B:
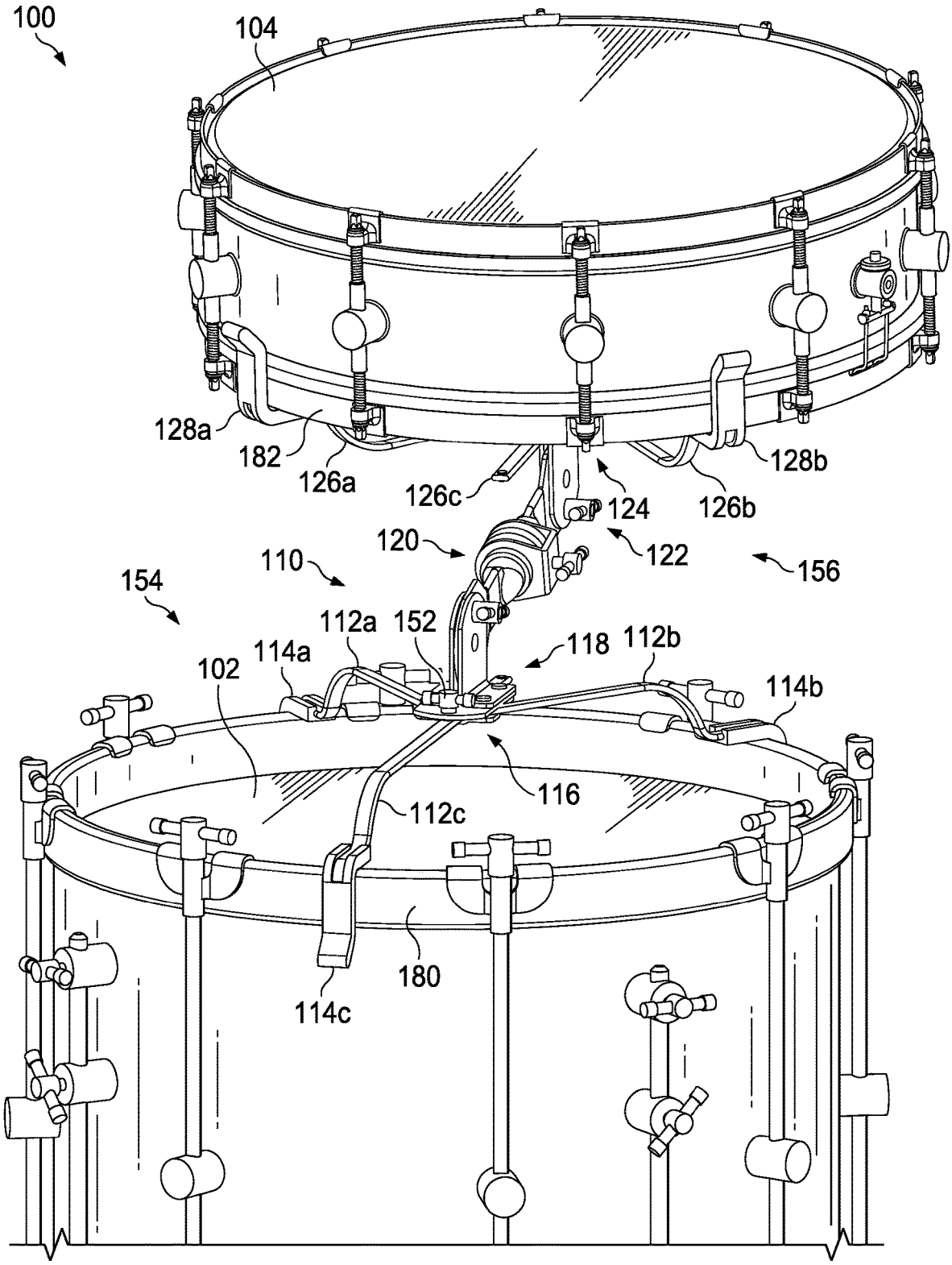
FIG. 1B is a simplified perspective view diagram of a portion of a cocktail drum, in accordance with an embodiment of the present disclosure.

Turning to FIG. 1B, FIG. 1B—is a simplified view of a portion of cocktail drum kit 100. In an example, cocktail drum kit 100 can include first drum 102, second drum 104, and a cocktail basket 110. Cocktail basket 110 can support second drum 104 over first drum 102. More specifically, cocktail basket can be on first drum rim 180 and support second drum 104 using second drum rim 182. In addition, cocktail basket 110 can allow second drum 104 to be moved along all three X, V. and Z axes relative to first drum 102 and can secure second drum 104 in a desired position relative to first drum 102 in a 3D plane.

Cocktail basket 110 can include first basket arms 112*a*-112*c*, first basket sleeves 114*a*-114*c*, first basket plate 116, first swivel plate 118, rotation and extension coupler 120, second swivel plate 122, second basket plate 124, second basket arms 126*a*-126*c*, and second basket sleeves 128*a*-128*c* (second basket sleeve 128*c* is not shown and/or not reference). In an example, first basket arms 112*a*-112*c*, first basket sleeves 114*a*-114*c*, first basket plate 116, and first swivel plate 118 can comprise a lower cocktail basket portion 154 and second swivel plate 122, second basket plate 124, second basket arms 126*a*-126*c*, and second basket sleeves 128*a*-128*c* can comprise an upper cocktail basket portion 156. Lower cocktail basket portion 154 can help to couple cocktail basket 110 to first drum 102 and upper cocktail basket portion 156 can help to couple cocktail basket 110 to second drum 104. Lower cocktail basket portion 154 and upper cocktail basket portion 156 can be a mirror image of each other. Rotation and extension coupler 120 can rotationally couple lower cocktail basket portion 154 to upper cocktail basket portion 156.

First basket plate 116 is coupled to first basket arms 112*a*-112*c* and allows them to collapse for storage and to pivot to help to support cocktail basket 110 on first drum 102. One or more of first basket arms 112*a*-112*c* can be coupled to first basket plate 116 using a pivot point (e.g., a pin, bar, rod, rivet, etc.) to allow one or more of first basket arms 112*a*-112*c* to pivot for storage and to pivot to help support cocktail basket 110 on first drum 102. A first basket plate tension screw 152 can be used to help secure first basket arms 112*a*-112*c* at a desired length from first pivot basket plate 116 and/or in a desired position or location. In an example, first basket plate 116 can slide across one or more first basket arms 112*a*-112*c* (or one or more first basket arms 112*a*-112*c* can slide through first basket plate 116) so the length or amount first basket arms 112*a*-112*c* extend from first basket plate 116 can be adjusted to accommodate different drum sizes. Once the length or amount first basket arms 112*a*-112*c* extend from first basket plate 116 is at the desired length, first basket plate tension screw 152 can be tightened to secure first basket arms 112*a*-112*c* at the desired length from first pivot basket plate 116 and/or in the desired position or location. First basket plate tension screw 152 can be a tension screw, thumb screw, etc.

More specifically, as illustrated in FIG. 1B, first basket arm 112*c* can slide through first basket plate 116 so the length or amount first basket arm 112*c* extends from first basket plate 116 can be adjusted to accommodate different drum sizes. In addition, each of first basket arms 112*a* and 112*b* can pivot or rotate to a desired position. Once the length or amount first basket arm 112*c* extends from first basket plate 116 is at the desired length and first basket arms 112*a* and 112*b* are in a desired position or location, first basket plate tension screw 152 can be tightened to secure first basket arms 112*a*-112*c* at the desired length from first pivot basket plate 116 and/or in the desired position or location.

Second basket plate 124 is coupled to second basket arms 126*a*-126*c* and allows them to collapse for storage and to pivot to help to support second drum 104 on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot for storage and to pivot to help support second drum 104 on cocktail basket 110. In an example, second basket plate 124 can slide across one or more second basket arms 126*a*-126*c* (or one or more second basket arms 126*a*-126*c* can slide through second basket plate 124) so the length or amount second basket arms 126*a*-126*c* extend from second basket plate 124 can be adjusted to accommodate different drum sizes.

More specifically, as illustrated in FIG. 1B, second basket arm 126*c* can slide through second basket plate 124 so the length or amount second basket arm 126*c* extends from second basket plate 124 can be adjusted to accommodate different drum sizes. In addition, each of second basket arms 124*a* and 124*b* can pivot or rotate to a desired position. Once the length or amount second basket arm 124*c* extends from second basket plate 124 is at the desired length and second basket arms 126*a* and 126*b* are in a desired position or location, a second basket plate tension screw (e.g., second basket plate tension screw 158 illustrated in FIG. 5) can be tightened to secure second basket arms 126*a*-126*c* at the desired length from second pivot basket plate 126 and/or in the desired position or location.

Figure 1C:
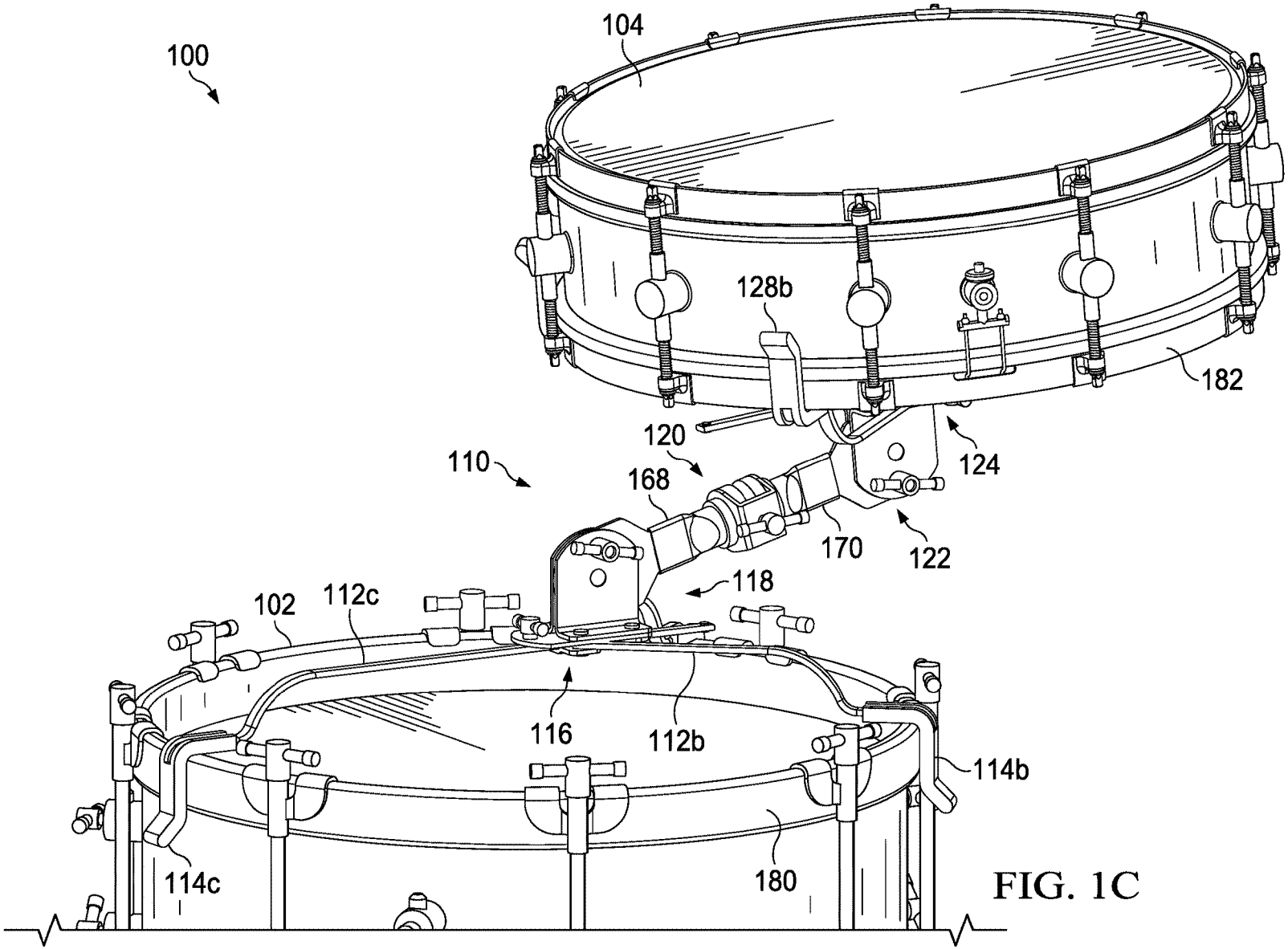
FIG. 1C is a simplified perspective view diagram of a portion of a cocktail drum, in accordance with an embodiment of the present disclosure.

Turning to FIG. 1C, FIG. 1C is a simplified view of a portion of cocktail drum kit 100. In an example, cocktail drum kit 100 can include first drum 102, second drum 104, and cocktail basket 110. Cocktail basket 110 can support second drum 104 over first drum 102. More specifically, cocktail basket can be on first drum rim 180 and support second drum 104 using second drum rim 182. In addition, cocktail basket 110 can allow second drum 104 to be moved along all three X, Y, and Z axes relative to first drum 102 and can secure second drum 104 in a desired position relative to first drum 102 in a 3D plane.

Cocktail basket 110 can include first basket arms 112*a*-112*c* (first basket arm 112*a* not shown and/or not referenced), first basket sleeves 114*a*-114*c* (first basket sleeve 112*a* not shown and/or not referenced), first basket plate 116, first swivel plate 118, rotation and extension coupler 120, second swivel plate 122, second basket plate 124, second basket arms 126*a*-126*c* (not shown and/or not referenced), and second basket sleeves 128*a*-128*c* (second basket sleeves 128*a* and 128*c* not shown and/or not referenced). Rotation and extension coupler 120 can include a first basket plate coupler 168 and a second basket plate coupler 170. First basket plate coupler 168 can couple rotation and extension coupler 120 to first swivel plate 118 and second basket plate coupler 170 can couple rotation and extension coupler 120 to second swivel plate 122.

Figure 1D:
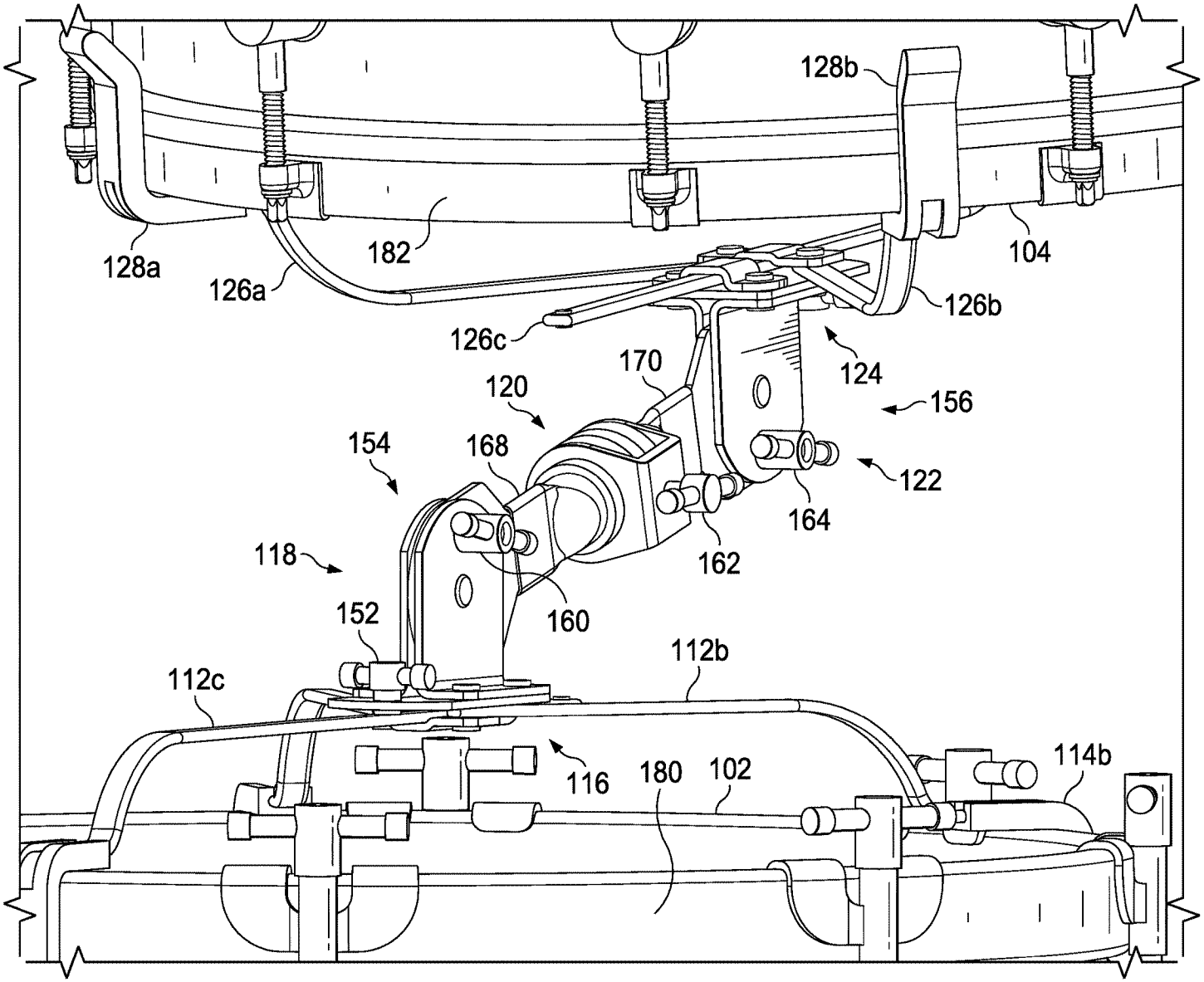
FIG. 1D is a simplified perspective view diagram of a portion of a cocktail drum, in accordance with an embodiment of the present disclosure.

Turning to FIG. 1D, FIG. 1D is a simplified view of a portion of cocktail drum kit 100. In an example, cocktail drum kit 100 can include first drum 102, second drum 104, and cocktail basket 110. Cocktail basket 110 can support second drum 104 over first drum 102. More specifically, cocktail basket can be on first drum rim 180 and support second drum 104 using second drum rim 182. In addition, cocktail basket 110 can allow second drum 104 to be moved along all three X, Y, and Z axes relative to first drum 102 and can secure second drum 104 in a desired position relative to first drum 102 in a 3D plane.

Cocktail basket 110 can include first basket arms 112*a*-112*c* (first basket arm 112*a* not referenced), first basket sleeves 114*a*-114*c* (first basket sleeve 114*a* not referenced), first basket plate 116, first swivel plate 118, rotation and extension coupler 120, second swivel plate 122, second basket plate 124, second basket arms 126*a*-126*c*, and second basket sleeves 128*a*-128*c* (second basket sleeve 128*c* not shown and/or not referenced).

First basket plate 116 is coupled to first basket arms 112*a*-112*c* and allows them to collapse for storage and to pivot to help to support cocktail basket 110 on first drum rim 180 of first drum 102. One or more of first basket arms 112*a*-112*c* can be coupled to first basket plate 116 using a pivot point (e.g., a pin, bar, rod, rivet, etc.) to allow one or more of first basket arms 112*a*-112*c* to pivot for storage and to pivot to help support cocktail basket 110 on first drum rim 180. In an example, first basket arm 112*c* can slide through first basket plate 116 so the length or amount first basket arm 112*c* extends from first basket plate 116 can be adjusted to accommodate different drum sizes. In a specific example, first basket plate tension screw 152 can be used to help control the length of a first basket arm 112*c* and secure first basket arms 112*a*-112*c* in place. When first basket plate tension screw 152 is not tight, first basket arm 112*c* can slide in and out of first basket plate 116 to adjust the length or distance from first basket plate 116 to first drum rim 180 or the outer edge of first drum 102. Also, first basket arms 112*a* and 112*b* can rotate to a desired position. When first basket plate tension screw 152 is tightened, first basket plate tension screw 152 can push down or apply a downward force on first basket arm 112*c*, and in some examples first basket arms 112*a* and 112*b*. The downward force causes the portion of first basket arms 112*a*-112*c* around first basket plate 116 to raise and cause the portions of first basket arms 112*a*-112*c* around first basket plate 116 to be forced together and creates a friction force that holds first basket arms 112*a*-112*c* in place.

Second basket plate 124 is coupled to second basket arms 126*a*-126*c* and allows them to collapse for storage and to pivot to help to support second drum rim 182 of second drum 104 on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot for storage and to pivot to help support second drum rim 182 on cocktail basket 110. In an example, a second basket plate tension screw (e.g., second basket plate tension screw 158 illustrated in FIG. 5), similar to first basket plate tension screw 152, can be used to help control the length of second basket arm 126*c* and secure second basket arms 126*a*-126*c* in place.

More specifically, second basket arm 126*c* can slide through second basket plate 124 so the length or amount second basket arm 126*c* extends from second basket plate 124 can be adjusted to accommodate different drum sizes. The second basket plate tension screw can be used to help secure second basket arms 126*a*-126*c* in place. When the second basket plate tension screw is not tight, second basket arm 126*c* can slide in and out of second basket plate 124 to adjust the length or distance from second basket plate 124 to the outer edge of second drum 104. In addition, second basket arms 126*a* and 126*b* can be rotated to a desired position. When the second basket plate tension screw is tightened, the second basket plate tension screw can push down or apply a downward force on second basket arm 126*c* and in some examples second basket arms 126*a* and 126*b*. The downward force causes the portion of second basket arm 126*c* around second basket plate 124 to raise and cause the portions of second basket arms 126*a*-126*c* around second basket plate 124 to be forced together and creates a friction force that holds second basket arms 126*a*-126*c* in place.

Rotation and extension coupler 120 can include first basket plate coupler 168 and second basket plate coupler 170. First basket plate coupler 168 can rotatably or pivotably couple rotation and extension coupler 120 to first swivel plate 118 and second basket plate coupler 170 can rotatably or pivotably couple rotation and extension coupler 120 to second swivel plate 122. First basket plate coupler 168 can allow rotation and extension coupler 120 to rotate or pivot up and down along the Y-axis relative to first swivel plate 118 and allow the position of second drum 104 to be changed relative to first drum 102. A first swivel plate tension screw 160 can be used to help secure or hold the position of first basket plate coupler 168 and rotation and extension coupler 120 relative to first swivel plate 118. More specifically, rotation and extension coupler 120 can rotate or pivot relative to first swivel plate 118 to a desired location or a location that positions second drum 104 in a desired location. Once extension coupler 120 is in the desired configuration or the configuration or location that positions second drum 104 in the desired location, first swivel plate tension screw 160 can be tightened to hold or fix the position of rotation and extension coupler 120 relative to first swivel plate 118. First swivel plate tension screw 160 can be a tension screw, thumb screw, etc.

Second basket plate coupler 170 can rotatably or pivotably couple rotation and extension coupler 120 to second swivel plate 122. Second basket plate coupler 170 can allow rotation and extension coupler 120 to rotate or pivot up and down along the Y-axis relative to second swivel plate 122 and allow the position of second drum 104 to be changed relative to first drum 102. A second swivel plate tension screw 164 can be used to help secure or hold the position of second basket plate coupler 170 and rotation and extension coupler 120 relative to second swivel plate 122. More specifically, rotation and extension coupler 120 can rotate or pivot relative to second swivel plate 122 to a desired location or location that positions second drum 104 in a desired location. Once extension coupler 120 is in the desired configuration or the configuration or location that positions second drum 104 in the desired location, second swivel plate tension screw 164 can be tightened to hold or fix the position of rotation and extension coupler 120 relative to second swivel plate 122. Second swivel plate tension screw 164 can be a tension screw, thumb screw, etc.

Rotation and extension coupler 120 can rotationally couple lower cocktail basket portion 154 (first basket arms 112*a*-112*c*, first basket sleeves 114*a*-114*c*, first basket plate 116, and first swivel plate 118) to upper cocktail basket portion 156 (second swivel plate 122, second basket plate 124, second basket arms 126*a*-126*c*, and second basket sleeves 128*a*-128*c*). More specifically, rotation and extension coupler 120 can allow second basket plate coupler 170 to be rotated or to pivot relative to first basket plate coupler 168. In addition, rotation and extension coupler 120 can allow second basket plate coupler 170 to extend away from first basket plate coupler 168 or to retract towards first basket plate coupler 168. For example, rotation and extension coupler 120 can couple lower cocktail basket portion 154 and upper cocktail basket portion 156 and allow upper cocktail basket portion 156 to be rotated relative to lower cocktail basket portion 154 as well as allow lower cocktail basket portion 154 and upper cocktail basket portion 156 to move towards and away from each other. Because upper cocktail basket portion 156 is coupled to second drum 104 and lower cocktail basket portion 154 is coupled to first drum 102, when upper cocktail basket portion 156 is rotated relative to lower cocktail basket portion 154, second drum 104 is rotated relative to first drum 102 and when lower cocktail basket portion 154 and upper cocktail basket portion 156 to move towards and away from each other, second drum 104 is moved towards and away from first drum 102.

Rotation and extension coupler 120 can include a U-clamp or some other mechanism that can couple lower cocktail basket portion 154 and upper cocktail basket portion 156 and allow upper cocktail basket portion 156 to be rotated relative to lower cocktail basket portion 154 as well as allow lower cocktail basket portion 154 and upper cocktail basket portion 156 to move towards and away from each other and to fix a location of upper cocktail basket portion 156 relative to lower cocktail basket portion 154. More specifically, a user can adjust rotation and extension coupler 120 to adjust the position or location of upper cocktail basket portion 156 relative to lower cocktail basket portion 154 and then secure upper cocktail basket portion 156 using rotation and extension coupler tension screw 162 such that upper cocktail basket portion 156 does not change its position or location relative to lower cocktail basket portion 154. Extension coupler tension screw 162 can be a tension screw, thumb screw, etc.

For purposes of illustrating certain example techniques of cocktail drum kit 100 and cocktail basket 110, the following foundational information may be viewed as a basis from which the present disclosure may be properly explained.

Cocktail drums are a type of portable drum kit that combines bass drum and snare drum sounds in a single drum. Some suggest that cocktail drum kits came about after WWII when jazz music reigned supreme. During this time, the era of big band music was waning and smaller combos playing bebop were beginning to emerge. Drum companies experimented with new types of drum kits and one style that caught on with consumers employed a single drum that doubled as both a kick drum and a snare drum.

Today, use of cocktail sets in modern music remains relatively rare but does remain a viable alternative for drummers looking to maximize portability and/or minimize stage space normally taken by a drum set. A cocktail set is also useful as an alternative to a traditional drum set for providing a retro or unique appearance to a group. Currently, the typical cocktail drum consisted of a floor tom (a cylindrical drum with no snares or rattle) with both top and bottom drumheads. The bottom head is typically struck with a foot-pedal-operated beater and tuned to achieve a bass drum sound. The top head is struck with sticks. In some cocktail drums, a snare drum on a floor stand is positioned close to the floor tom to achieve a snare drum sound. In other cocktail drums, the snare drum is attached to the outside side surface of the floor tom using a rigid support. Once attached to the floor tom, the snare drum can only be moved in one plane up or down and cannot be moved sideways or closer to or further away from the user.

The drum's height normally requires the musician to play it standing upright with one foot operating the pedal and one foot bearing the weight of the musician's body (as opposed to a trap set that is played sitting down). This makes the cocktail drum quite easy to move from place to place, as opposed to moving a snare drum, stand for the snare drum, stool, and bass drum for a trap set. However, once attached to the floor tom, the snare drum cannot be moved or adjusted along the X, Y, Z axis. Some cocktail drums allow the snare drum to be moved or adjusted along one or even two axes but not all three X, Y, and Z axes.

A cocktail drum, as outlined in FIGS. 1A-1D, can resolve these issues (and others). A cocktail drum (e.g., cocktail drum kit 100) can be configured to allow a second drum (e.g., a snare) to be moved relative to a first drum (e.g., floor torn) along all three X, Y, and Z axes relative to the first drum and to be secured in a desired position relative to the first drum in a 3D plane. More specifically, the cocktail drum can include a cocktail basket (e.g., cocktail basket 110) that can support the second drum (e.g., snare or second drum 104) over the first drum (e.g., floor tom drum or first drum 102). The cocktail basket can be coupled to or sit on the top rim (e.g., first drum rim 180) or outside edge of the first drum and can be coupled to the bottom rim (e.g., second drum rim 182) or outside edge of the second drum or the second drum can sit inside or on the top part of the cocktail basket.

In an example, a lower cocktail basket portion (e.g., lower cocktail basket portion 154) can include first basket arms (e.g., first basket arms 112*a*-112*c*), first basket sleeves (e.g., first basket sleeves 114*a*-114*c*), a first basket plate (e.g., first basket plate 116), and a first swivel plate (e.g., first swivel plate 118). An upper cocktail basket portion 156 can include a second swivel plate (e.g., second swivel plate 122), a second basket plate (e.g., second basket plate 124), second basket arms (e.g., second basket arms 126*a*-126*c*), and second basket sleeves (e.g., second basket sleeves 128*a*-128*c*). The lower cocktail basket portion can help to couple the cocktail basket to the first drum and the upper cocktail basket portion can help to couple the cocktail basket to the second drum. In some examples, the lower cocktail basket portion and the upper cocktail basket portion are a mirror image of each other. A rotation and extension coupler (e.g., rotation and extension coupler 120) can rotationally couple the lower cocktail basket portion to the upper cocktail basket portion and allow the upper cocktail basket portion to extend away from and back towards the lower cocktail basket portion. The rotation and extension coupler can include a first basket plate coupler and a second basket plate coupler.

The lower cocktail basket portion can sit or be coupled to the rim of the first drum using the first basket sleeves and the first basket arms. The first basket arms are coupled to the first basket plate and the length of the first basket arms or distance of first basket sleeves from the first basket plate can be adjusted to accommodate different drum sizes. The first basket plate is coupled to the first swivel plate. The first swivel plate is rotatively or pivotably coupled to the first basket plate coupler of the rotation and extension coupler. The rotation and extension coupler can rotate or pivot up and down along the Y-axis relative to the first swivel plate and help allow the position of the second drum to be changed relative to the first drum.

The rotation and extension coupler can allow the second basket plate coupler of the rotation and extension coupler to be rotated or to pivot relative to the first basket plate coupler of the rotation and extension coupler. In addition, the rotation and extension coupler can allow the second basket plate coupler to extend away from the first basket plate coupler or to retract towards the first basket plate coupler. For example, the rotation and extension coupler couples the lower cocktail basket portion and the upper cocktail basket portion and can allow the upper cocktail basket portion to be rotated relative to the lower cocktail basket portion as well as allow the lower cocktail basket portion and the upper cocktail basket portion to move towards and away from each other. Because the upper cocktail basket portion is coupled to the second drum and the lower cocktail basket portion is coupled to the first drum, when the upper cocktail basket portion is rotated relative to the lower cocktail basket portion, the second drum is rotated relative to the first drum and when the lower cocktail basket portion and the upper cocktail basket portion to move towards and away from each other, the second drum is moved towards and away from the first drum.

The second basket plate coupler can rotatably or pivotably couple the rotation and extension coupler to the second swivel plate. The second basket plate coupler of the rotation and extension coupler can rotate or pivot up and down along the Y-axis relative to the second swivel plate and help allow the position of the second drum to be changed relative to the first drum. The second swivel plate is coupled to the second basket plate. The second basket arms can extend from the second basket plate. The second basket sleeves can be located on the ends of the second basket arms. The second drum can be supported by the upper cocktail basket portion using the second basket sleeves and the second basket arms. The second basket arms are coupled to the second basket plate and the length of the second basket arms or distance of the second basket sleeves from the second basket plate can be adjusted to accommodate different drum sizes. Because the lower cocktail basket portion can sit or be coupled to the rim of the first drum using the first basket sleeves and the first basket arms, the cocktail basked is not rigidly secured to the first drum and can be moved along the X-axis related to the first drum. More specifically, by changing the location of the first basket sleeves on the rim of the first drum and the first basket arms, the cocktail basket and second drum can be moved along the X-axis relative to the first drum. The first basket sleeves, first basket arms, first swivel plate, rotation and extension coupler, and second swivel plate allow the second drum to be moved relative to the first drum along all three X, Y, and Z axes relative to the first drum.

Figure 2:
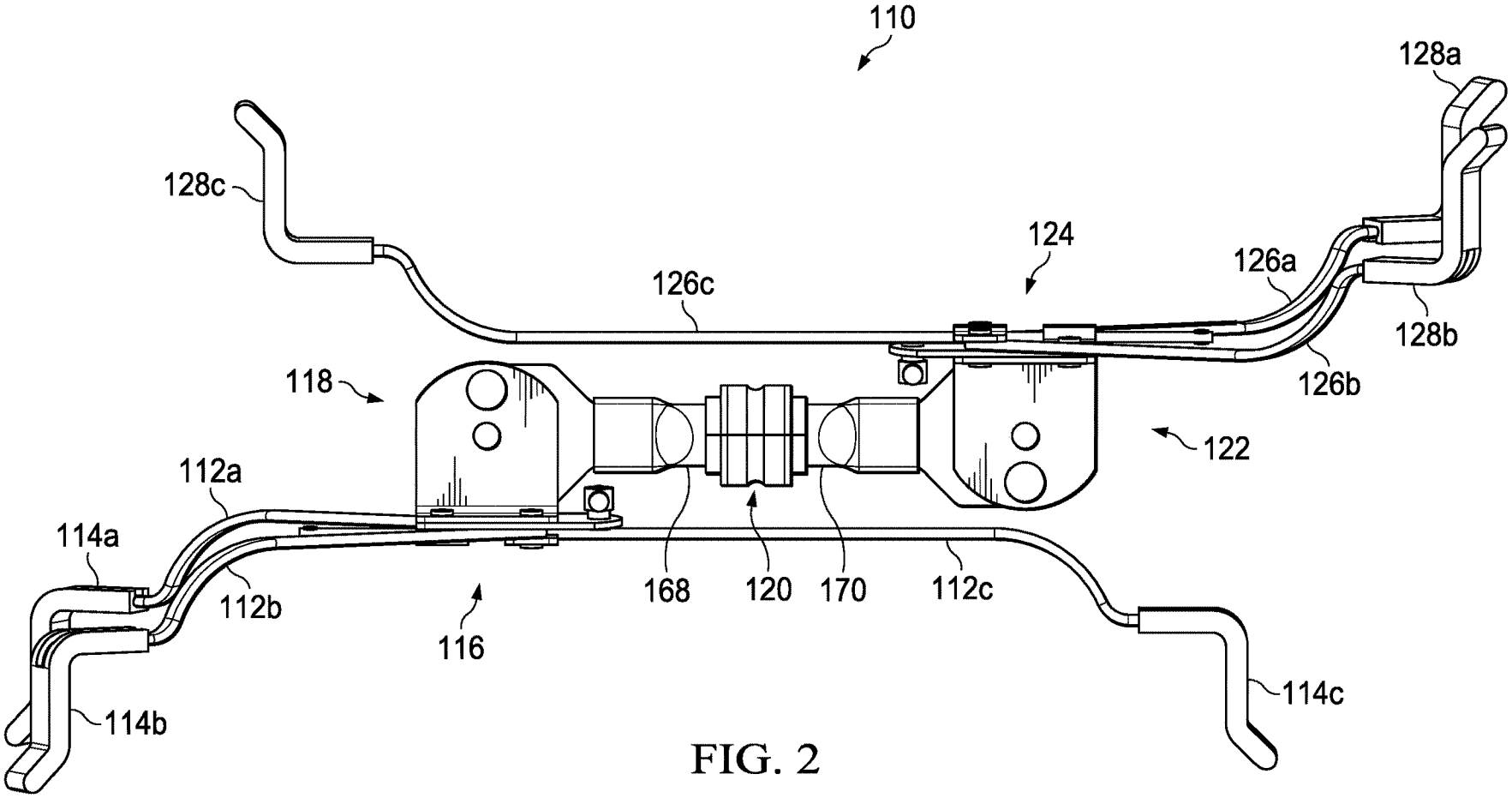
FIG. 2 is a simplified perspective view diagram of a cocktail drum basket, in accordance with an embodiment of the present disclosure.

Turning to FIG. 2, FIG. 2 is a simplified view of cocktail basket 110. Cocktail basket 110 can include first basket arms 112*a*-112*c*, first basket sleeves 114*a*-114*c*, first basket plate 116, first swivel plate 118, rotation and extension coupler 120, second swivel plate 122, second basket plate 124, second basket arms 126*a*-126*c*, and second basket sleeves 128*a*-128*c*.

First basket plate 116 is coupled to first basket arms 112*a*-112*c* and allows them to collapse for storage and to pivot to help to support cocktail basket 110 on a first drum (e.g., first drum 102). One or more of first basket arms 112*a*-112*c* can be coupled to first basket plate 116 using a pivot point (e.g., a pin, bar, rod, rivet, etc.) to allow one or more of first basket arms 112*a*-112*c* to pivot for storage and to pivot to help support cocktail basket 110. Second basket plate 124 is coupled to second basket arms 126*a*-126*c* and allows one or more of second basket arms 126*a*-126*c* to pivot or rotate for storage and to pivot to help to support a second drum (e.g., second drum 104) on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot for storage and to pivot to help support a second drum (e.g., second drum 104) on cocktail basket 110.

Rotation and extension coupler 120 can include first basket plate coupler 168 and second basket plate coupler 170. First basket plate coupler 168 can rotatably or pivotably couple rotation and extension coupler 120 to first swivel plate 118 and second basket plate coupler 170 can rotatably or pivotably couple rotation and extension coupler 120 to second swivel plate 122. First basket plate coupler 168 can allow rotation and extension coupler 120 to rotate or pivot up and down along the Y-axis relative to first swivel plate 118 and allow the position of the second drum to be changed relative to a first drum (e.g., first drum 102). Second basket plate coupler 170 can rotatably or pivotably couple rotation and extension coupler 120 to second swivel plate 122. Second basket plate coupler 170 can allow rotation and extension coupler 120 to rotate or pivot up and down along the Y-axis relative to second swivel plate 122 and allow the position of the second drum to be changed relative to the first drum.

Rotation and extension coupler 120 can rotationally couple lower cocktail basket portion 154 (first basket arms 112*a*-112*c*, first basket sleeves 114*a*-114*c*, first basket plate 116, and first swivel plate 118) to upper cocktail basket portion 156 (second swivel plate 122, second basket plate 124, second basket arms 126*a*-126*c*, and second basket sleeves 128*a*-128*c*). More specifically, rotation and extension coupler 120 can allow second basket plate coupler 170 to be rotated or to pivot relative to first basket plate coupler 168. In addition, rotation and extension coupler 120 can allow second basket plate coupler 170 to extend away from first basket plate coupler 168 or to retract towards first basket plate coupler 168. For example, rotation and extension coupler 120 can couple lower cocktail basket portion 154 and upper cocktail basket portion 156 and allow upper cocktail basket portion 156 to be rotated relative to lower cocktail basket portion 154 as well as allow lower cocktail basket portion 154 and upper cocktail basket portion 156 to move towards and away from each other.

Rotation and extension coupler 120 can be a U-clamp or some other mechanism that can couple lower cocktail basket portion 154 and upper cocktail basket portion 156 and allow upper cocktail basket portion 156 to be rotated relative to lower cocktail basket portion 154 as well as allow lower cocktail basket portion 154 and upper cocktail basket portion 156 to move towards and away from each other and to fix a location of upper cocktail basket portion 156 relative to lower cocktail basket portion 154. More specifically, a user can adjust rotation and extension coupler 120 to adjust the position or location of upper cocktail basket portion 156 relative to lower cocktail basket portion 154 and then secure upper cocktail basket portion 156 such that it does not change the position or location relative to lower cocktail basket portion 154. By adjusting the location of first basket sleeves 114*a*-114*c* on the rim or edges of the first drum, adjusting the position of rotation and extension coupler 120 relative to first swivel plate 118 and/or second swivel plate 122, rotating second basket plate coupler 170 relative to first basket plate coupler 168, and/or extending or retracting second basket coupler 170 towards or away from first basket plate coupler 168, the second drum can be moved relative to the first drum along all three X, Y, and Z axes.

Figure 3:
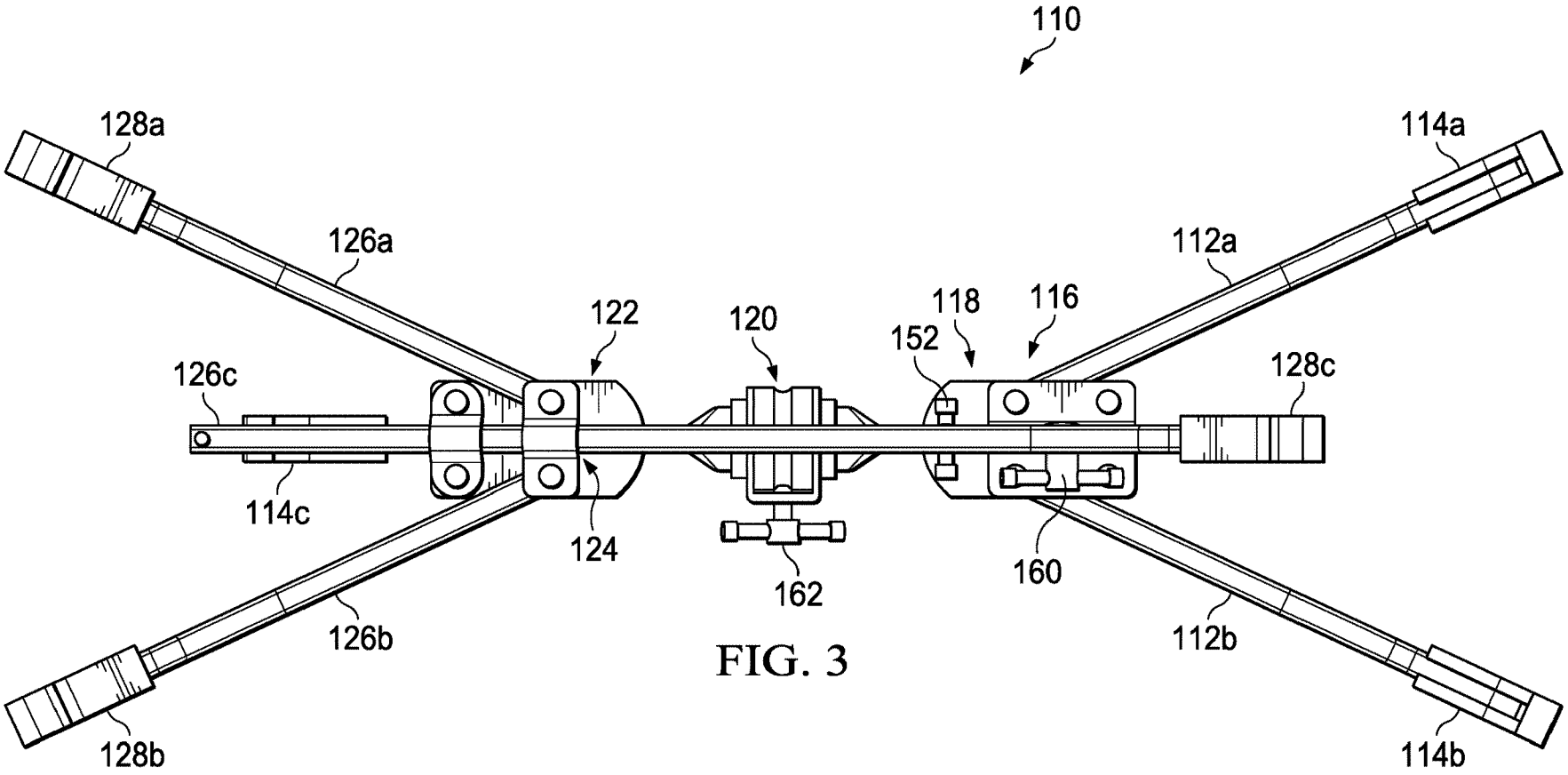
FIG. 3 is a simplified top view diagram of a cocktail drum basket, in accordance with an embodiment of the present disclosure.

Turning to FIG. 3, FIG. 3 is a simplified top view of cocktail basket 110. Cocktail basket 110 can include first basket arms 112*a*-112*c* (first basket arm 112*c* not shown and/or not referenced), first basket sleeves 114*a*-114*c*, first basket plate 116, first swivel plate 118, rotation and extension coupler 120, second swivel plate 122, second basket plate 124, second basket arms 126*a*-126*c*, and second basket sleeves 128*a*-128*c*.

First basket plate 116 is coupled to first basket arms 112*a*-112*c* and allows them to collapse for storage and to pivot to help to support cocktail basket 110 on a first drum (e.g., first drum 102). One or more of first basket arms 112*a*-112*c* can be coupled to first basket plate 116 using a pivot point (e.g., a pin, bar, rod, rivet, etc.) to allow one or more of first basket arms 112*a*-112*c* to pivot for storage and to pivot to help support cocktail basket 110.

Second basket plate 124 is coupled to second basket arms 126*a*-126*c* and allows them to collapse for storage and to pivot to help to support second drum 104 on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot for storage and to pivot to help support second drum 104 on cocktail basket 110.

Rotation and extension coupler 120 can rotatably or pivotably coupled to first swivel plate 118 to allow rotation and extension coupler 120 to rotate or pivot up and down the Y-axis relative to first swivel plate 118 and allow the position of second drum 104 to be changed relative to first drum 102. First swivel plate tension screw 160 can be used to help secure or hold the position of rotation and extension coupler 120 relative to first swivel plate 118. More specifically, rotation and extension coupler 120 can rotate or pivot relative to first swivel plate 118 to a desired location or location that positions the second drum in a desired location. Once extension coupler 120 is in the desired configuration or the configuration or location that positions the second drum in the desired location, first swivel plate tension screw 160 can be tightened to hold or fix the position of rotation and extension coupler 120 relative to first swivel plate 118.

In addition, rotation and extension coupler 120 can be rotatably or pivotably coupled to second swivel plate 122 to allow rotation and extension coupler 120 to rotate or pivot up and down along the Y-axis relative to second swivel plate 122 and allow the position of the second drum to be changed relative to the first drum. A second swivel plate tension screw (e.g., second swivel plate tension screw 164 illustrated in FIG. 1D) can be used to help secure or hold the position of rotation and extension coupler 120 relative to second swivel plate 122. More specifically, rotation and extension coupler 120 can rotate or pivot relative to second swivel plate 122 to a desired location or location that positions the second drum in a desired location. Once extension coupler 120 is in the desired configuration or the configuration or location that positions the second drum in the desired location, the second swivel plate tension screw can be tightened to hold or fix the position of rotation and extension coupler 120 relative to second swivel plate 122.

Rotation and extension coupler 120 can allow second swivel plate 122 to be rotated or to pivot relative to first swivel plate 118. In addition, rotation and extension coupler 120 can allow second swivel plate 122 to extend away from first swivel plate 118 or to retract towards first swivel plate 118. For example, rotation and extension coupler 120 can couple first swivel plate 118 and second swivel plate 122 and allow second swivel plate 122 to be rotated relative to first swivel plate 118 as well as allow first swivel plate 118 and second swivel plate 122 to move towards and away from each other. Once extension coupler 120 is in the desired configuration or the configuration or location that positions the second drum in the desired location, rotation and extension coupler tension screw 162 can be tightened to hold or fix the position of rotation and extension coupler 120.

Figure 4:
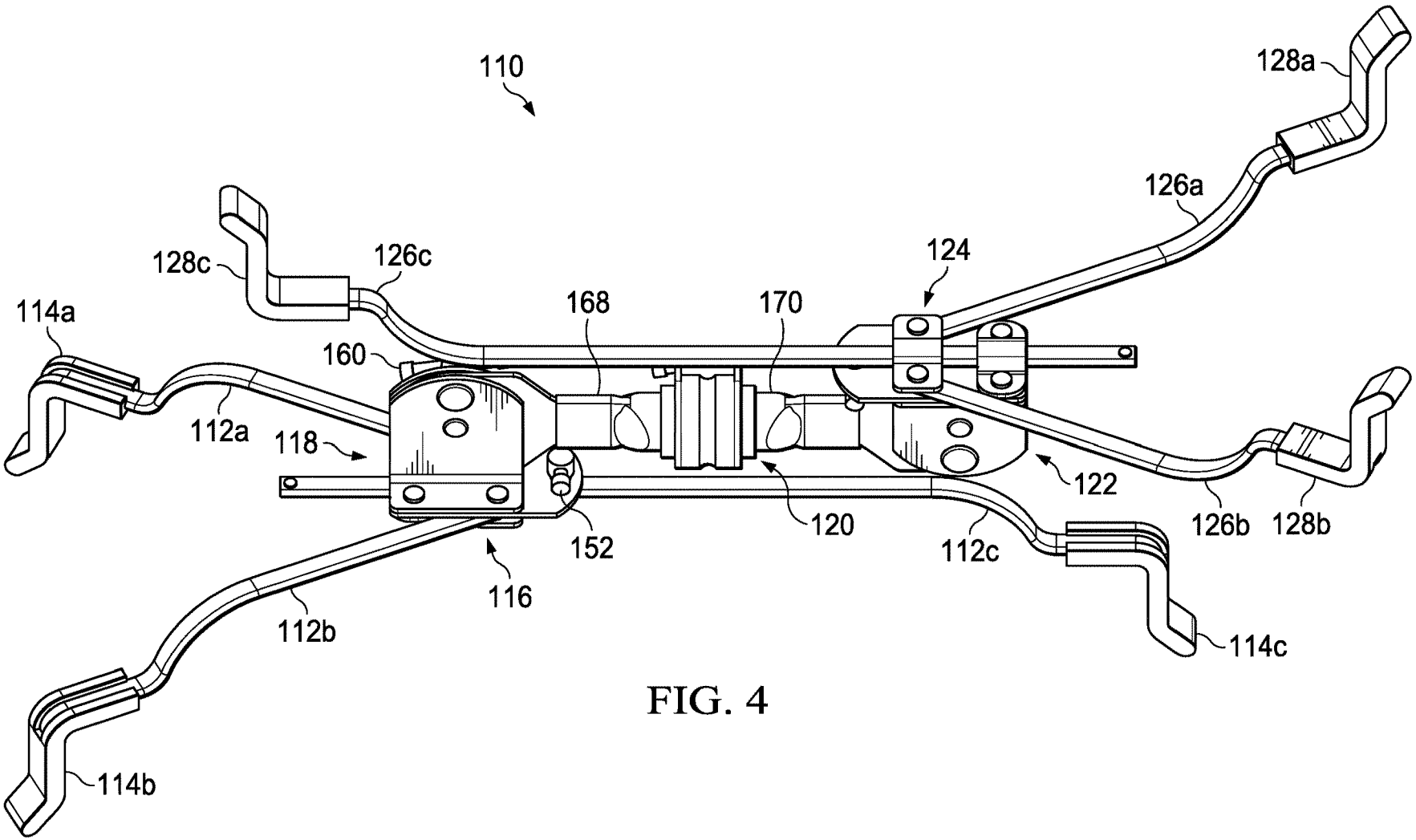
FIG. 4 is a simplified perspective view diagram of a cocktail drum basket, in accordance with an embodiment of the present disclosure.

Turning to FIG. 4, FIG. 4 is a simplified view of cocktail basket 110 in an open configuration. Cocktail basket 110 can include first basket arms 112*a*-112*c*, first basket sleeves 114*a*-114*c*, first basket plate 116, first swivel plate 118, rotation and extension coupler 120, second swivel plate 122, second basket plate 124, second basket arms 126*a*-126*c*, and second basket sleeves 128*a*-128*c*.

First basket plate 116 is coupled to first basket arms 112*a*-112*c* and allows them to collapse for storage and to pivot to help to support cocktail basket 110 on a first drum (e.g., first drum 102). One or more of first basket arms 112*a*-112*c* can be coupled to first basket plate 116 using a pivot point (e.g., a pin, bar, rod, rivet, etc.) to allow one or more of first basket arms 112*a*-112*c* to pivot for storage and to pivot to help support cocktail basket 110. In an example, first basket plate 116 can slide across one or more first basket arms 112*a*-112*c* (or one or more first basket arms 112*a*-112*c* can slide through first basket plate 116) so the length or amount first basket arms 112*a*-112*c* extend from first basket plate 116 can be adjusted to accommodate different drum sizes. Once the length or amount first basket arms 112*a*-112*c* extend from first basket plate 116 is at the desired length, first basket plate tension screw 152 can be tightened to secure first basket arms 112*a*-112*c* at the desired length from first pivot basket plate 116 and/or in the desired position or location.

Second basket plate 124 is coupled to second basket arms 126*a*-126*c* and allows them to collapse for storage and to pivot to help to support a second drum (e.g., second drum 104) on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot for storage and to pivot to help support the second drum on cocktail basket 110. In an example, second basket plate 124 can slide across one or more second basket arms 126*a*-126*c* (or one or more second basket arms 126*a*-126*c* can slide through second basket plate 124) so the length or amount second basket arms 126*a*-126*c* extend from second basket plate 124 can be adjusted to accommodate different drum sizes.

Rotation and extension coupler 120 can include first basket plate coupler 168 and second basket plate coupler 170. First basket plate coupler 168 can rotatably or pivotably couple rotation and extension coupler 120 to first swivel plate 118 and second basket plate coupler 170 can rotatably or pivotably couple rotation and extension coupler 120 to second swivel plate 122. First basket plate coupler 168 can allow rotation and extension coupler 120 to rotate or pivot up and down relative to first swivel plate 118 and allow the position of the second drum to be changed relative to a first drum (e.g., first drum 102). First swivel plate tension screw 160 can be used to help secure or hold the position of first basket plate coupler 168 and rotation and extension coupler 120 relative to first swivel plate 118. More specifically, rotation and extension coupler 120 can rotate or pivot relative to first swivel plate 118 to a desired location or location that positions the second drum in a desired location. Once extension coupler 120 is in the desired configuration or the configuration or location that positions the second drum in the desired location, first swivel plate tension screw 160 can be tightened to hold or fix the position of rotation and extension coupler 120 relative to first swivel plate 118.

Second basket plate coupler 170 can rotatably or pivotably couple rotation and extension coupler 120 to second swivel plate 122. Second basket plate coupler 170 can allow rotation and extension coupler 120 to rotate or pivot up and down relative to second swivel plate 122 and allow the position of the second drum to be changed relative to the first drum. A second swivel plate tension screw (e.g., second swivel plate tension screw 164 illustrated in FIG. 1D) can be used to help secure or hold the position of second basket plate coupler 170 and rotation and extension coupler 120 relative to second swivel plate 122. More specifically, rotation and extension coupler 120 can rotate or pivot relative to second swivel plate 122 to a desired location or location that positions the second drum in a desired location. Once extension coupler 120 is in the desired configuration or the configuration or location that positions the second drum in the desired location, the second swivel plate tension screw 164 can be tightened to hold or fix the position of rotation and extension coupler 120 relative to second swivel plate 122.

Rotation and extension coupler 120 can rotationally couple first basket arms 112*a*-112*c*, first basket sleeves 114*a*-114*c*, first basket plate 116, and first swivel plate 118 (e.g., lower cocktail basket portion 154 illustrated in FIG. 1B) to second swivel plate 122, second basket plate 124, second basket arms 126*a*-126*c*, and second basket sleeves 128*a*-128*c* (e.g., upper cocktail basket portion 156 illustrated in FIG. 1B). More specifically, rotation and extension coupler 120 can allow second basket plate coupler 170 to be rotated or to pivot relative to first basket plate coupler 168. In addition, rotation and extension coupler 120 can allow second basket plate coupler 170 to extend away from first basket plate coupler 168 or to retract towards first basket plate coupler 168.

Figure 5:
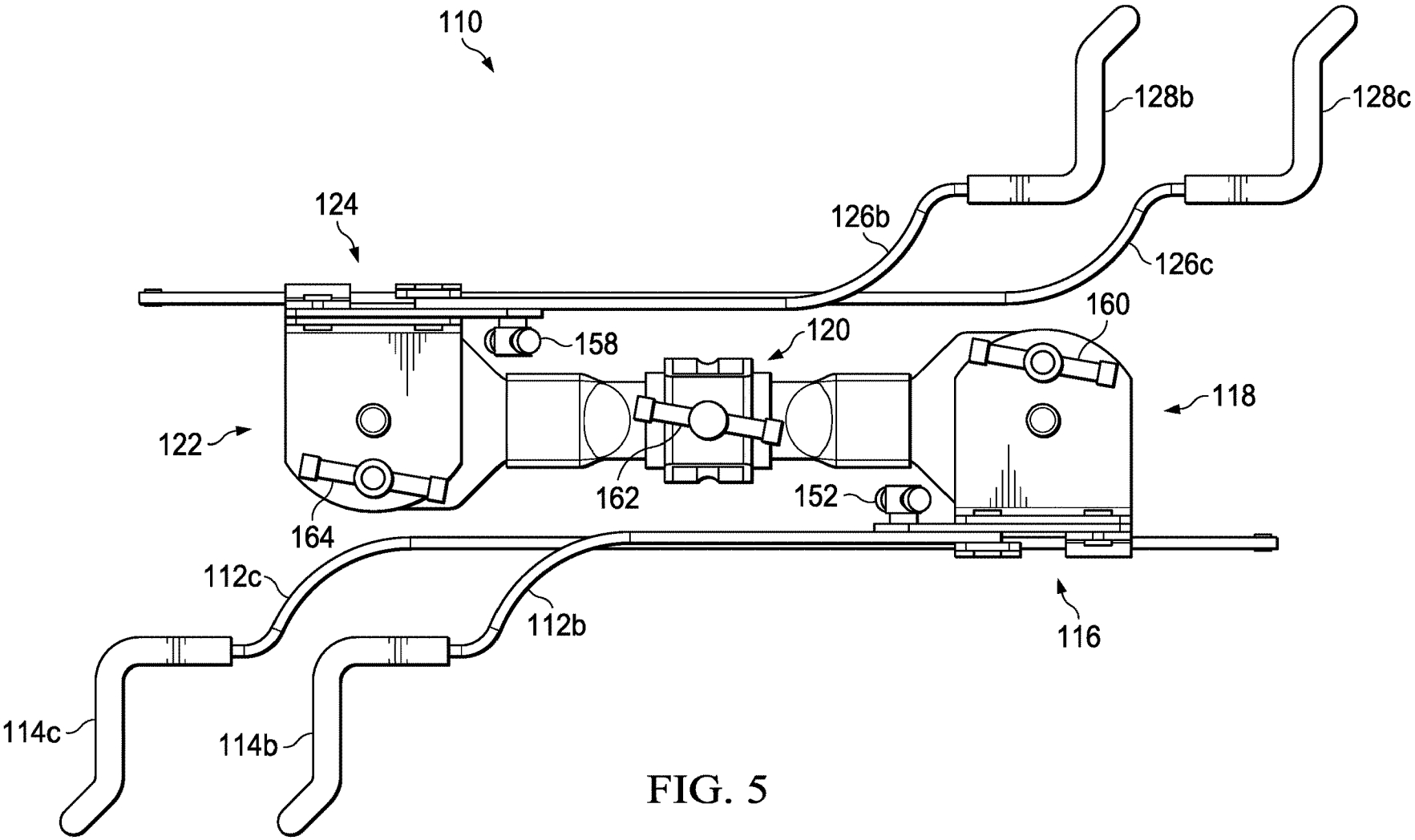
FIG. 5 is a simplified side view diagram of a cocktail drum basket, in accordance with an embodiment of the present disclosure.

Turning to FIG. 5, FIG. 5 is a simplified view of cocktail basket 110 in a closed configuration or storage configuration. Cocktail basket 110 can include first basket arms 112*a*-112*c* (first basket arm 112*a* not shown and/or not referenced), first basket sleeves 114*a*-114*c* (first basket sleeve 114*a* not shown and/or not referenced), first basket plate 116, first swivel plate 118, rotation and extension coupler 120, second swivel plate 112, second basket plate 124, second basket arms 126*a*-126*c* (second basket arm 126*a* not shown and/or not referenced), and second basket sleeves 128*a*-128*c* (second basket sleeve 128*a* not shown and/or not referenced).

First basket plate 116 is coupled to first basket arms 112*a*-112*c* and allows them to collapse for storage and to pivot to help to support cocktail basket 110 on a first drum (e.g., first drum 102). One or more of first basket arms 112*a*-112*c* can be coupled to first basket plate 116 using a pivot point (e.g., a pin, bar, rod, rivet, etc.) to allow one or more of first basket arms 112*a*-112*c* to pivot to a storage configuration for storage, as illustrated in FIG. 5, and to pivot to an open configuration to help support cocktail basket 110 on a rim of the first drum, as illustrated in FIG. 1B. First basket plate tension screw 152 can be tightened to secure first basket arms 112*a*-112*c* in a desired position or location.

When first basket plate tension screw 152 is not tight, first basket arm 112*c* can slide in and out of first basket plate 116 to adjust the length or distance from first basket plate 116 to the outer edge or rim of a first drum. In addition, first basket arms 112*a* and 112*b* can pivot from a storage position to an open configuration and back to a storage configuration. When first basket plate tension screw 152 is tightened, first basket plate tension screw 152 can push down or apply a downward force on first basket arm 112*c* and in some examples on first basket arms 112*a* and 112*b*. The downward force causes the portion of first basket arm 112*c* around first basket plate 116 to raise and cause the portions of first basket arms 112*a*-112*c* around first basket plate 116 to be forced together and creates a friction force that holds first basket arms 112*a*-112*c* in place.

Second basket plate 124 is coupled to second basket arms 126*a*-126*c* and allows them to collapse for storage and to pivot to help to support a second drum on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot to a storage configuration for storage, as illustrated in FIG. 5, and to pivot to an open configuration help support a rim of the second drum on cocktail basket 110 as illustrated in FIG. 1B.

When second basket plate tension screw 158 is not tight, second basket arm 126*c* can slide in and out of second basket plate 124 to adjust the length or distance from second basket plate 124 to the outer edge or rim of the second drum. In addition, second basket arms 126*a* and 126*b* can pivot from a storage position to an open configuration and back to a storage configuration. When second basket plate tension screw 158 is tightened, second basket plate tension screw 158 can push down or apply a downward force on second basket arm 126*c*, and in some examples second basket arms 126*a* and 126*b*. The downward force causes the portion of second basket arm 126*c* around second basket plate 124 to raise and cause the portions of second basket arms 126*a*-126*c* around second basket plate 124 to be forced together and creates a friction force that holds second basket arms 126*a*-126*c* in place. Second basket plate tension screw 158 can be a tension screw, thumb screw, etc.

Rotation and extension coupler 120 can rotate or pivot up and down relative to first swivel plate 118 and allow the position of the second drum to be changed relative to the first drum. First swivel plate tension screw 160 can be used to help secure or hold the position of rotation and extension coupler 120 relative to first swivel plate 118. Once extension coupler 120 is in the desired configuration or the configuration or location that positions the second drum in the desired location, first swivel plate tension screw 160 can be tightened to hold or fix the position of rotation and extension coupler 120 relative to first swivel plate 118. In addition, rotation and extension coupler 120 can rotate or pivot up and down relative to second swivel plate 122 and allow the position of the second drum to be changed relative to the first drum. Second swivel plate tension screw 164 can be used to help secure or hold the position of rotation and extension coupler 120 relative to second swivel plate 122. More specifically, rotation and extension coupler 120 can rotate or pivot relative to second swivel plate 122 to a desired location or location that positions the second drum in a desired location. Once extension coupler 120 is in the desired configuration or the configuration or location that positions the second drum in the desired location, second swivel plate tension screw 164 can be tightened to hold or fix the position of rotation and extension coupler 120 relative to second swivel plate 122.

Rotation and extension coupler 120 can rotationally couple first basket arms 112*a*-112*c*, first basket sleeves 114*a*-114*c*, first basket plate 116, and first swivel plate 118 (e.g., lower cocktail basket portion 154 illustrated in FIG. 1B) to second swivel plate 122, second basket plate 124, second basket arms 126*a*-126*c*, and second basket sleeves 128*a*-128*c* (e.g., upper cocktail basket portion 156 illustrated in FIG. 1B). More specifically, rotation and extension coupler 120 can allow second swivel plate 122 to be rotated or to pivot relative to first swivel plate 118. In addition, rotation and extension coupler 120 can allow second swivel plate 122 to extend away from first swivel plate 118 or to retract towards first swivel plate 118. For example, rotation and extension coupler 120 can couple first swivel plate 118 and second swivel plate 122 and allow second swivel plate 122 to be rotated relative to first swivel plate 118 as well as allow first swivel plate 118 and second swivel plate 122 to move towards and away from each other. Once extension coupler 120 is in the desired configuration or the configuration or location that positions second drum 104 in the desired location, rotation and extension coupler tension screw 162 can be tightened to hold or fix the position of rotation and extension coupler 120.

Figure 6:
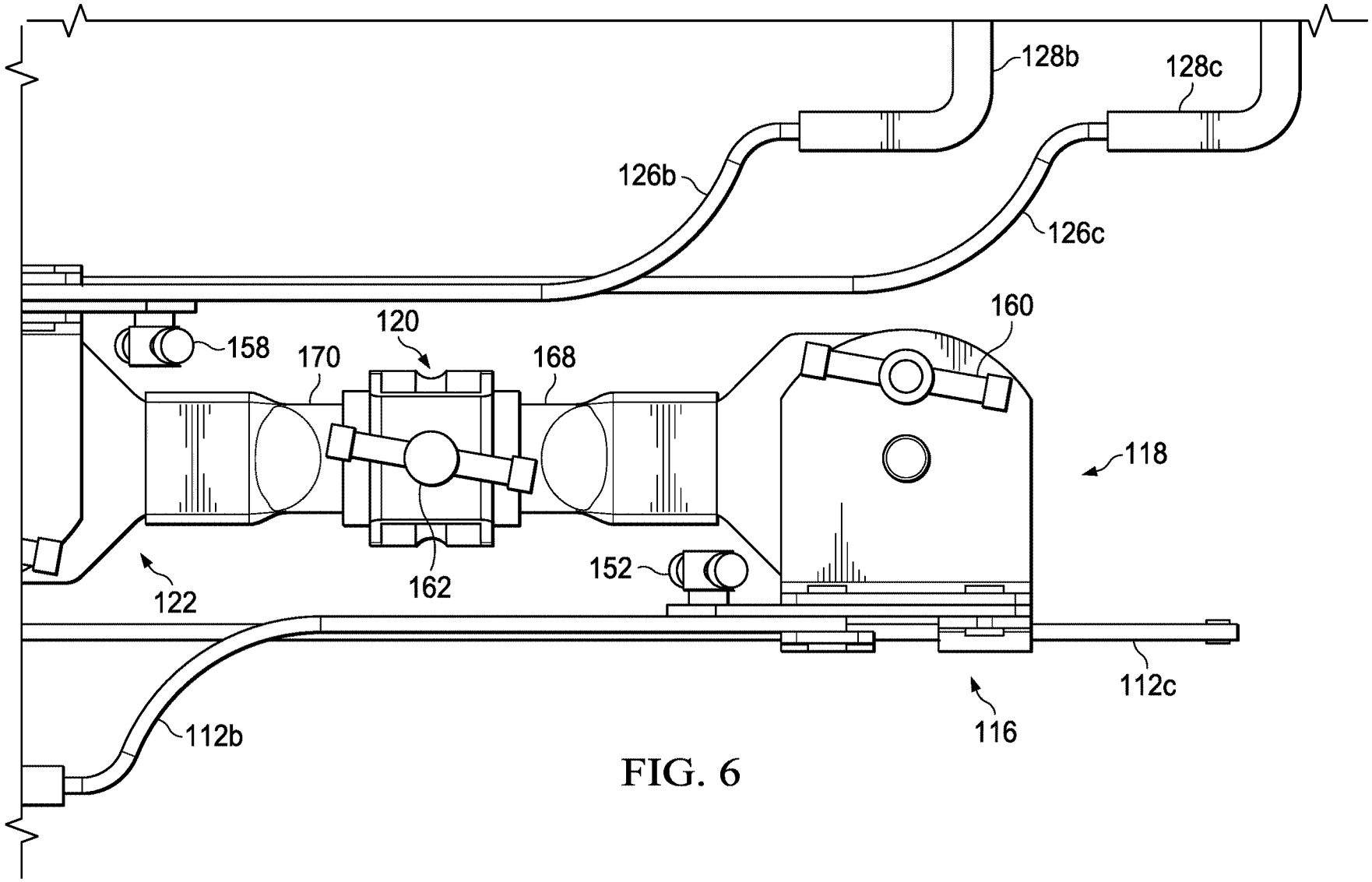
FIG. 6 is a simplified side view diagram of a portion of a cocktail drum basket, in accordance with an embodiment of the present disclosure.

Turning to FIG. 6, FIG. 6 is a simplified view of a portion of cocktail basket 110. Cocktail basket 110 can include first basket arms 112*a*-112*c* (first basket arm 112*a* not referenced and/or not shown), first basket plate 116, first swivel plate 118, rotation and extension coupler 120, second basket arms 126*a*-126*c* (second basket arms 126*a* not referenced and/or shown), and second basket sleeves 128*a*-128*c* (second basket sleeves 128*a* not referenced and/or shown).

First basket plate 116 is coupled to first basket arms 112*a*-112*c* and allows them to collapse for storage and to pivot to help to support cocktail basket 110 on a first drum (e.g., first drum 102). One or more of first basket arms 112*a*-112*c* can be coupled to first basket plate 116 using a pivot point (e.g., a pin, bar, rod, rivet, etc.) to allow one or more of first basket arms 112*a*-112*c* to pivot for storage and to pivot to help support cocktail basket 110. In an example, first basket plate 116 can slide across one or more first basket arms 112*a*-112*c* (or one or more first basket arms 112*a*-112*c* can slide through first basket plate 116) so the length or amount first basket arms 112*a*-112*c* extend from first basket plate 116 can be adjusted to accommodate different drum sizes. Once the length or amount first basket arms 112*a*-112*c* extend from first basket plate 116 is at the desired length and/or are rotated to a desired position, first basket plate tension screw 152 can be tightened to secure first basket arms 112*a*-112*c* at the desired length from first pivot basket plate 116 and/or in the desired position or location.

Rotation and extension coupler 120 can include first basket plate coupler 168 and second basket plate coupler 170. First basket plate coupler 168 can rotatably or pivotably couple rotation and extension coupler 120 to first swivel plate 118 and second basket plate coupler 170 can rotatably or pivotably couple rotation and extension coupler 120 to second swivel plate 122. First basket plate coupler 168 can allow rotation and extension coupler 120 to rotate or pivot up and down relative to first swivel plate 118 and allow the position of a second drum (e.g., second drum 104) to be changed relative to a first drum (e.g., first drum 102). First swivel plate tension screw 160 can be used to help secure or hold the position of first basket plate coupler 168 and rotation and extension coupler 120 relative to first swivel plate 118. More specifically, rotation and extension coupler 120 can rotate or pivot relative to first swivel plate 118 to a desired location or location that positions the second drum in a desired location. Once extension coupler 120 is in the desired configuration or the configuration or location that positions the second drum in the desired location, first swivel plate tension screw 160 can be tightened to hold or fix the position of rotation and extension coupler 120 relative to first swivel plate 118.

Second basket plate coupler 170 can rotatably or pivotably couple rotation and extension coupler 120 to second swivel plate 122. Second basket plate coupler 170 can allow rotation and extension coupler 120 to rotate or pivot up and down relative to second swivel plate 122 and allow the position of the second drum to be changed relative to the first drum. Rotation and extension coupler 120 can allow second swivel plate 122 to be rotated or to pivot relative to first swivel plate 118. In addition, rotation and extension coupler 120 can allow second swivel plate 122 to extend away from first swivel plate 118 or to retract towards first swivel plate 118. For example, rotation and extension coupler 120 can couple first swivel plate 118 and second swivel plate 122 and allow second swivel plate 122 to be rotated relative to first swivel plate 118 as well as allow first swivel plate 118 and second swivel plate 122 to move towards and away from each other. Once extension coupler 120 is in the desired configuration or the configuration or location that positions the second drum in the desired location, rotation and extension coupler tension screw 162 can be tightened to hold or fix the position of rotation and extension coupler 120.

Figure 7:
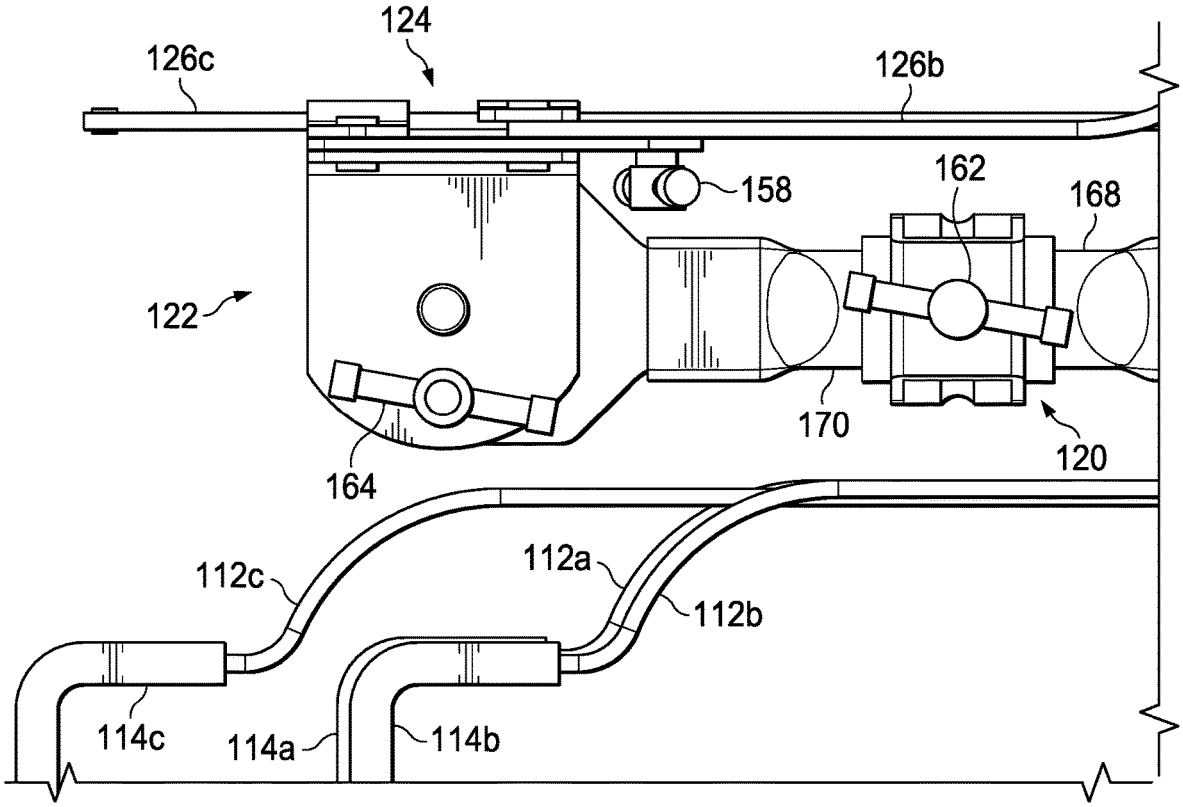
FIG. 7 is a simplified side view diagram of a portion of a cocktail drum basket, in accordance with an embodiment of the present disclosure.

Turning to FIG. 7, FIG. 7 is a simplified view of a portion of cocktail basket 110. Cocktail basket 110 can include first basket arms 112*a*-112*c*, first basket sleeves 114*a*-114*c*, first basket plate 116 (not shown), rotation and extension coupler 120, second swivel plate 122, second basket plate 124, and second basket arms 126*a*-126*c* (basket arm 126*a* is not shown and/or not referenced.

Second basket plate 124 is coupled to second basket arms 126*a*-126*c* and allows them to collapse for storage and to pivot to help to support second drum 104 on cocktail basket 110. One or more of second basket arms 126*a*-126*c* can be coupled to second basket plate 124 using a pivot point (e.g., a pin, bar, rod, rivet, etc.) to allow one or more of second basket arms 126*a*-126*c* to pivot for storage and to pivot to help support a second drum (e.g., second drum 104) on cocktail basket 110. In an example, second basket plate 124 can slide across one or more second basket arms 126*a*-126*c* (or one or more second basket arms 126*a*-126*c* can slide through second basket plate 124) so the length or amount second basket arms 126*a*-126*c* extend from second basket plate 124 can be adjusted to accommodate different drum sizes. Once the length or amount second basket arms 126*a*-126*c* extend from second basket plate 124 is at the desired length and/or are rotated to a desired position, second basket plate tension screw 158 can be tightened to secure second basket arms 126*a*-126*c* at the desired length from second pivot basket plate 124 and/or in the desired position or location.

Rotation and extension coupler 120 can include first basket plate coupler 168 and second basket plate coupler 170. Second basket plate coupler 170 can rotatably or pivotably couple rotation and extension coupler 120 to second swivel plate 122. Second basket plate coupler 170 can allow rotation and extension coupler 120 to rotate or pivot up and down relative to second swivel plate 122 and allow the position of the second drum to be changed relative to a first drum (e.g., first drum 102). Second swivel plate tension screw 164 can be used to help secure or hold the position of second basket plate coupler 170 and rotation and extension coupler 120 relative to second swivel plate 122. More specifically, rotation and extension coupler 120 can rotate or pivot relative to second swivel plate 122 to a desired location or location that positions the second drum in a desired location. Once extension coupler 120 is in the desired configuration or the configuration or location that positions the second drum in the desired location, second swivel plate tension screw 164 can be tightened to hold or fix the position of rotation and extension coupler 120 relative to second swivel plate 122.

Rotation and extension coupler 120 can allow second basket plate coupler 170 to be rotated or to pivot relative to first basket plate coupler 168. In addition, rotation and extension coupler 120 can allow second basket plate coupler 170 to extend away from first basket plate coupler 168 or to retract towards first basket plate coupler 168. Once extension coupler 120 is in the desired configuration or the configuration or location that positions the second drum in the desired location, rotation and extension coupler tension screw 162 can be tightened to hold or fix the position of rotation and extension coupler 120.

Figure 8:
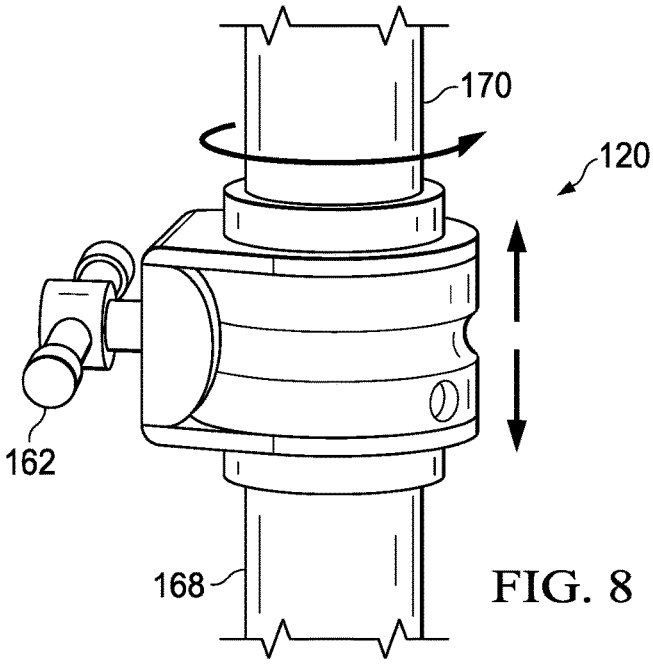
FIG. 8 is a simplified side view diagram of a portion of a cocktail drum, in accordance with an embodiment of the present disclosure.

Turning to FIG. 8, FIG. 8 is a simplified view of a portion of rotation and extension coupler 120. Rotation and extension coupler 120 can include first basket plate coupler 168 and second basket plate coupler 170. First basket plate coupler 168 can rotatably or pivotably couple rotation and extension coupler 120 to first swivel plate 118 (not shown) and second basket plate coupler 170 can rotatably or pivotably couple rotation and extension coupler 120 to second swivel plate 122 (not shown). Once extension coupler 120 is in the desired configuration or the configuration or location that positions a second drum (e.g., second drum 104) in the desired location, rotation and extension coupler tension screw 162 can be tightened to hold or fix the position of rotation and extension coupler 120.

Rotation and extension coupler 120 can include a U-clamp or some other mechanism that can couple a lower cocktail basket portion (e.g., lower cocktail basket portion 154 illustrated in FIG. 1B) and an upper cocktail basket portion (e.g., upper cocktail basket portion 156 illustrated in FIG. 1B) and allow the upper cocktail basket portion to be rotated relative to the lower cocktail basket portion as well as allow the lower cocktail basket portion and the upper cocktail basket portion to move towards and away from each other and to fix a location of the upper cocktail basket portion relative to the lower cocktail basket portion. More specifically, a user can adjust rotation and extension coupler 120 to adjust the position or location of the upper cocktail basket portion relative to the lower cocktail basket portion and then secure the upper cocktail basket portion using rotation and extension coupler tension screw 162 such that the upper cocktail basket portion does not change its configuration, position, or location relative to the lower cocktail basket portion.

Figure 9:
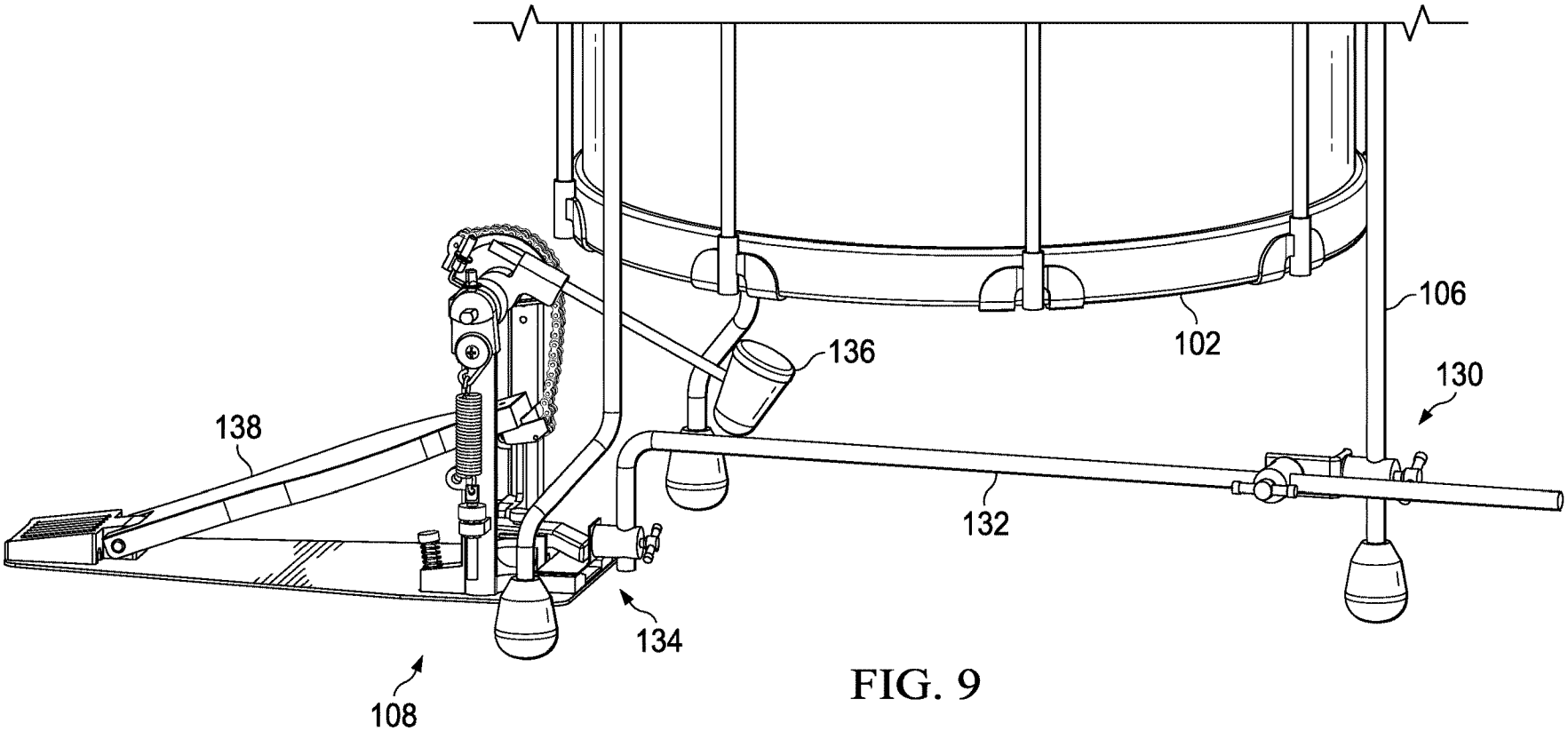
FIG. 9 is a simplified side view diagram of a portion of a cocktail drum, in accordance with an embodiment of the present disclosure.

Turning to FIG. 9, FIG. 9 is a simplified view of a portion of first drum 102. First drum 102 can include plurality of legs 106. In an example, a pedal 108 can be coupled to leg 106 of first drum 102 using a pedal attachment mechanism 130 and a support rod 132. Pedal 108 can include a foot pedal 138, a pedal attachment plate 134, and a beater 136. When a user pushes down on foot pedal 138, beater 136 can strike first drum 102.

Figure 10:
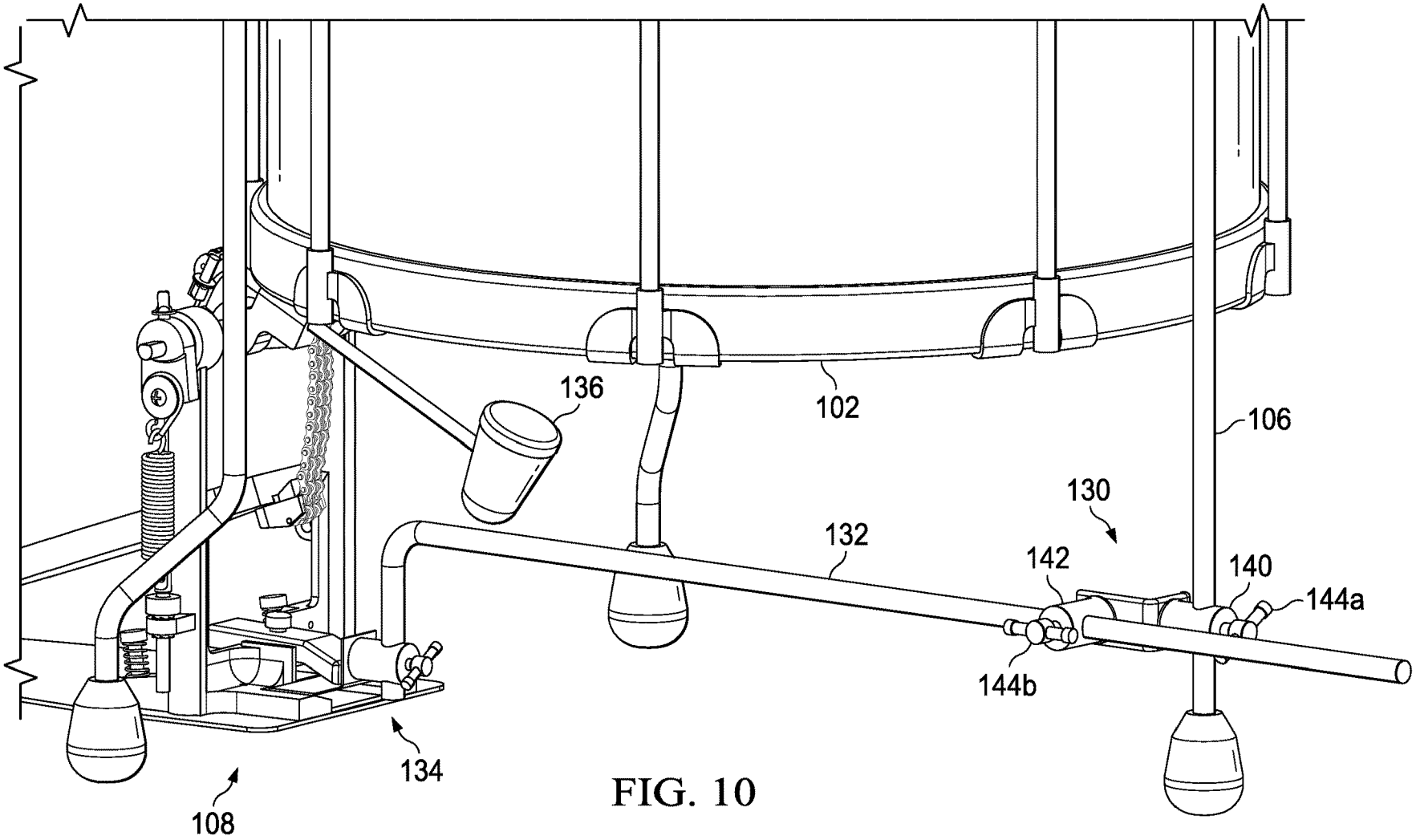
FIG. 10 is a simplified perspective view diagram of a portion of a cocktail drum, in accordance with an embodiment of the present disclosure.

Turning to FIG. 10, FIG. 10 is a simplified view of a portion of first drum 102. First drum 102 can include plurality of legs 106. Pedal 108 can include pedal attachment plate 134 and beater 136. Pedal can be coupled to a specific leg 106 of first drum 102 using pedal attachment mechanism 130 and support rod 132. Pedal attachment mechanism 130 can include leg attachment mechanism 140, support rod attachment mechanism 142, and securing means 144*a* and 144*b*. Securing means 144*a* and 144*b* can be a tension screw, thumb screw, etc.

Figure 11:
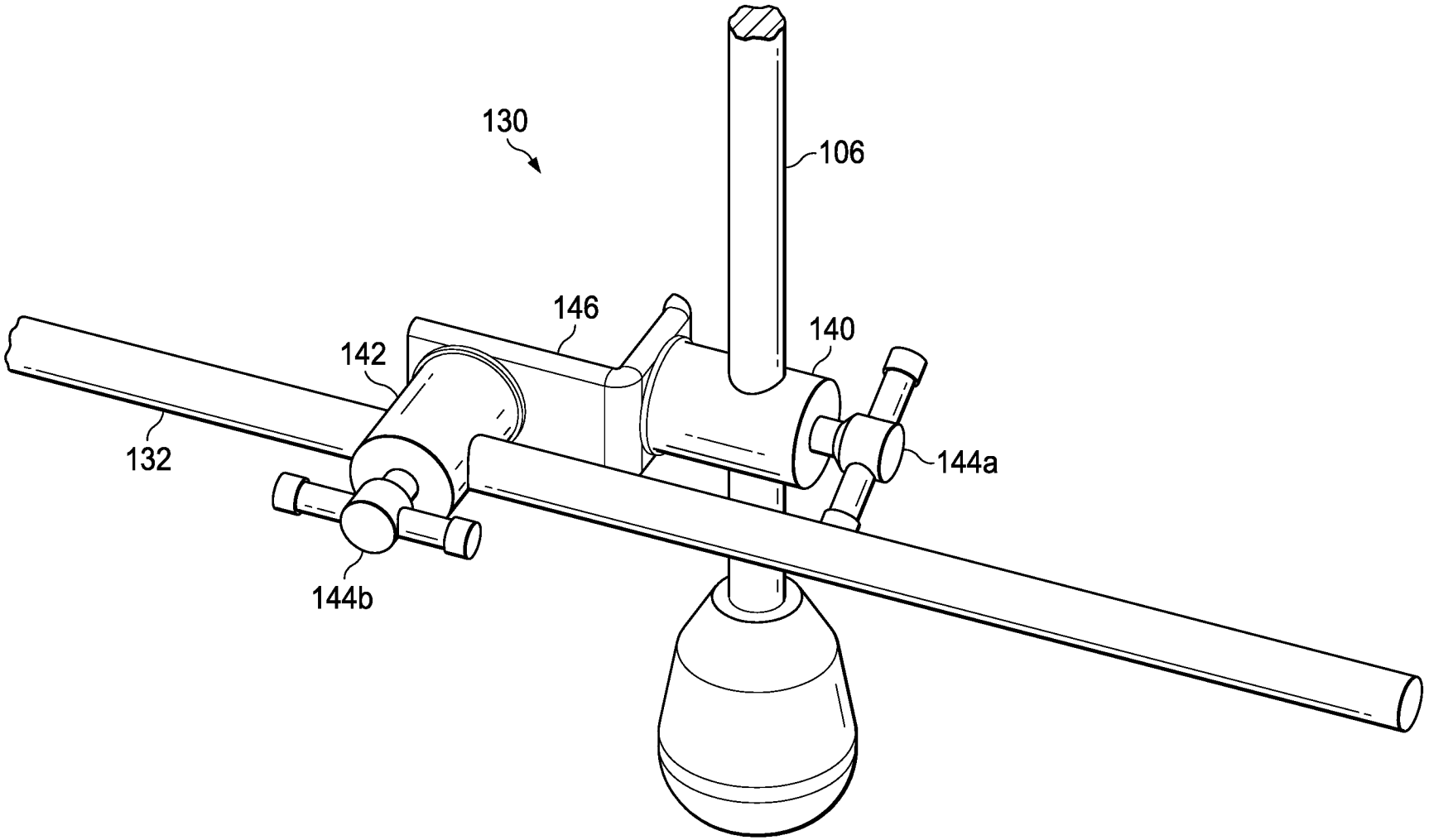
FIG. 11 is a simplified perspective view diagram of a portion of a cocktail drum, in accordance with an embodiment of the present disclosure.

Turning to FIG. 11, FIG. 11 is a simplified view of a portion of pedal attachment mechanism 130 and support rod 132. Pedal attachment mechanism 130 can include leg attachment mechanism 140, support rod attachment mechanism 142, and securing means 144*a* and 144*b*. Leg attachment mechanism 140 can be coupled to leg 106. In an example, an L-plate 146 can couple leg attachment mechanism 140 to support rod attachment mechanism 142.

Figure 12:
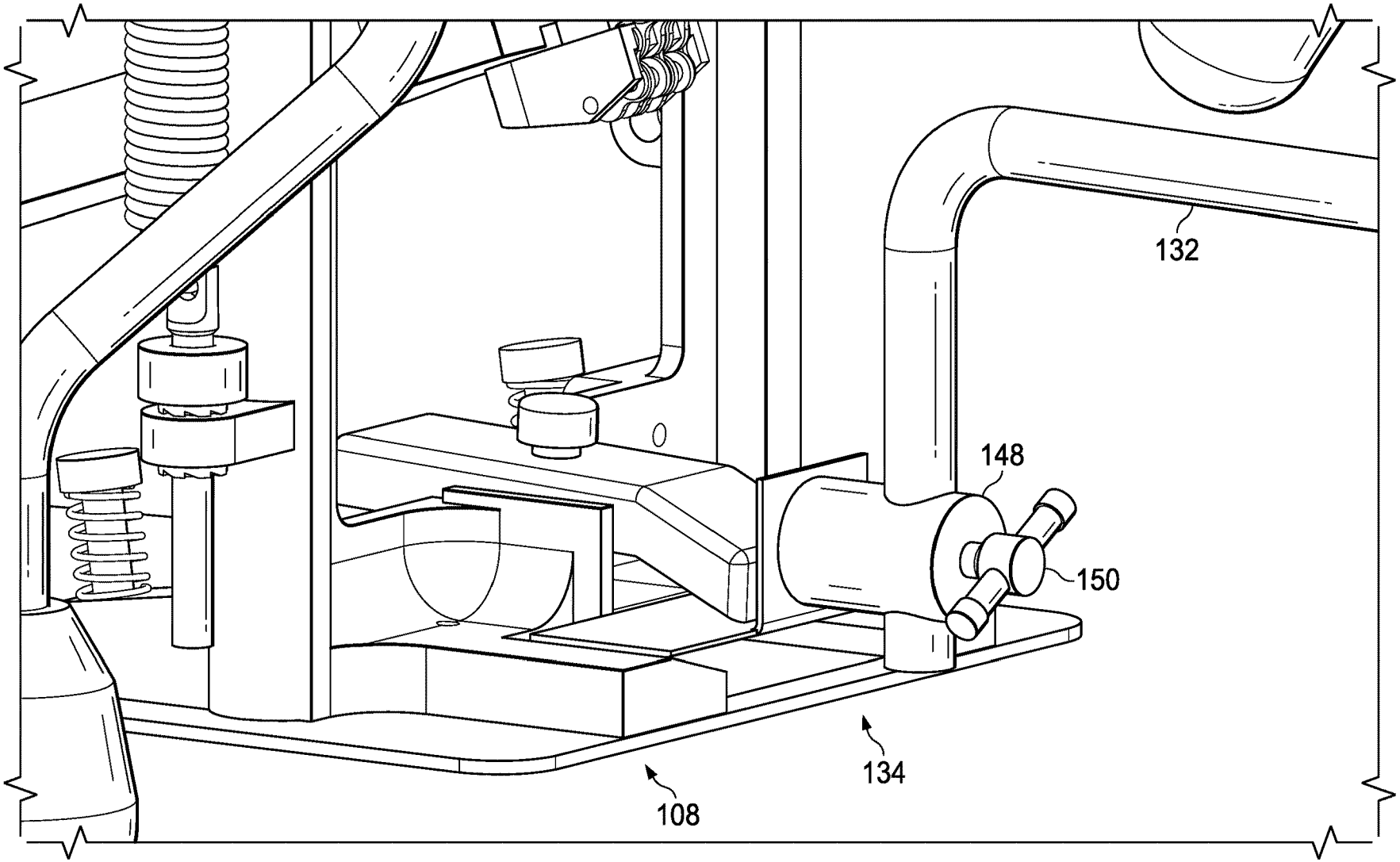
FIG. 12 is a simplified perspective view diagram of a portion of a cocktail drum, in accordance with an embodiment of the present disclosure.

Turning to FIG. 12, FIG. 12 is a simplified view of a portion of pedal 108. Pedal 108 can include pedal attachment plate 134. Pedal attachment plate 134 can include pedal support rod attachment mechanism 148 that couples support rod 132 to pedal 108. Support rod 132 can be secured to support rod attachment mechanism 148 using securing means 150. Securing means 150 can be a tension screw, thumb screw, etc.

Figure 13:
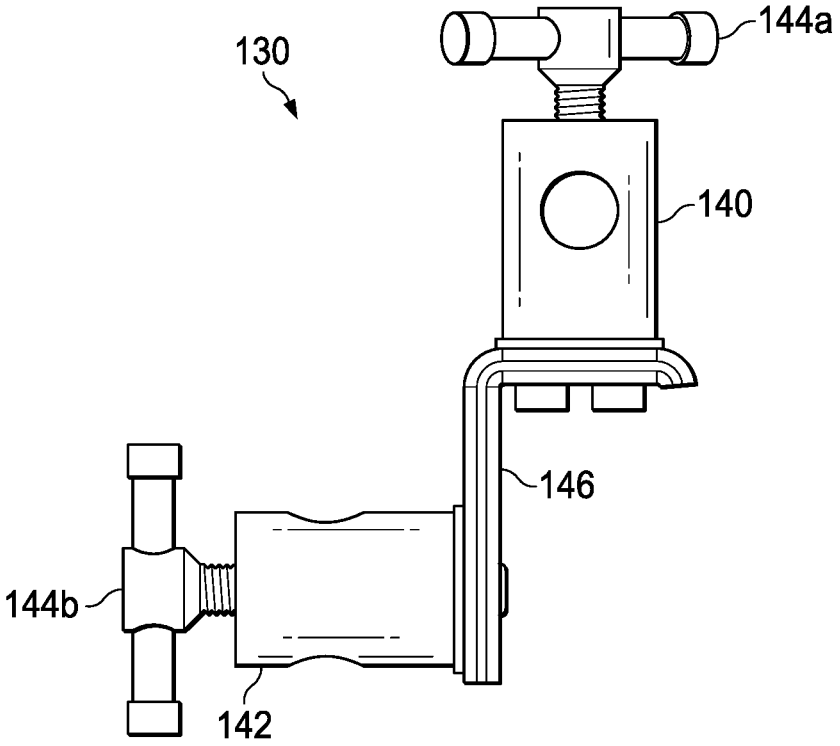
FIG. 13 is a simplified side view diagram of a portion of a cocktail drum, in accordance with an embodiment of the present disclosure.

Turning to FIG. 13, FIG. 13 is a simplified view of pedal attachment mechanism 130. Pedal attachment mechanism 130 can include leg attachment mechanism 140, support rod attachment mechanism 142, and securing means 144*a* and 114*b*. L-plate 146 can couple leg attachment mechanism 140 to support rod attachment mechanism 142.

Figure 14:
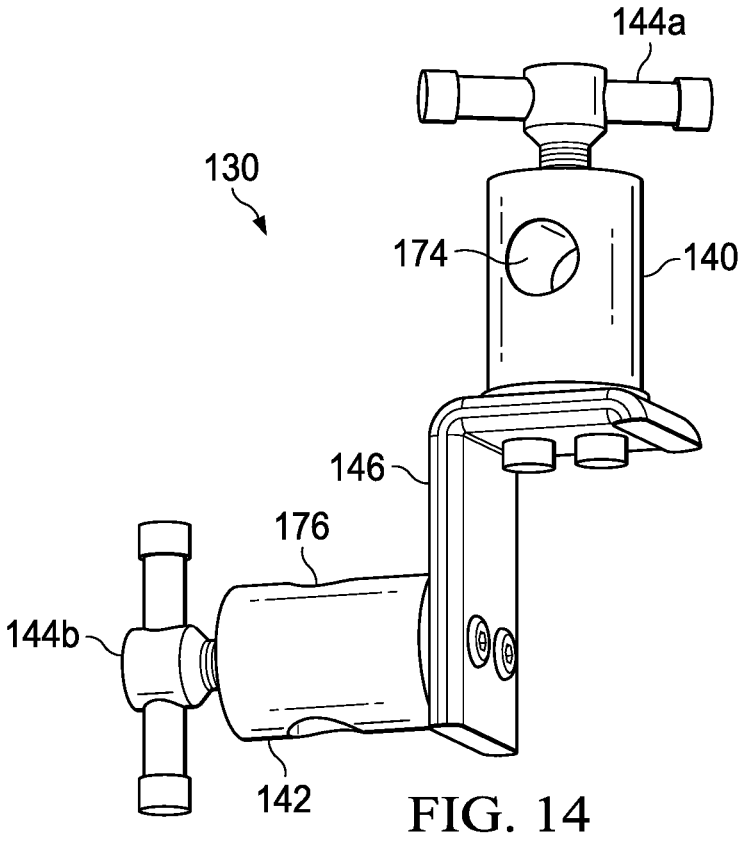
FIG. 14 is a simplified perspective view diagram of a portion of a cocktail drum, in accordance with an embodiment of the present disclosure.

Turning to FIG. 14, FIG. 14 is a simplified view of pedal attachment mechanism 130. Pedal attachment mechanism 130 can include leg attachment mechanism 140, support rod attachment mechanism 142, and securing means 144*a* and 114*b*. L-plate 146 can couple leg attachment mechanism 140 to support rod attachment mechanism 142. Leg attachment mechanism 140 can include a leg attachment receptacle 174 where a leg of a drum (e.g., leg 106 of first drum 102 illustrated in FIG. 9) can pass through leg attachment mechanism 140. After the leg has been inserted into and through leg attachment receptacle 174, securing means 144*a* can be tightened onto the leg in leg attachment receptacle 174 to secure leg attachment mechanism 140 to the leg of the drum. Support rod attachment mechanism 142 can include a support rod attachment receptacle 176 where a support rod (e.g., support rod 132 illustrated in FIG. 9) can pass through support rod attachment mechanism 142. After the support rod has been inserted into and through support rod attachment receptacle 176, securing means 144*b* can be tightened onto the support rod in support rod attachment receptacle 176 to secure support rod attachment mechanism 142 to the support rod.

Figure 15:
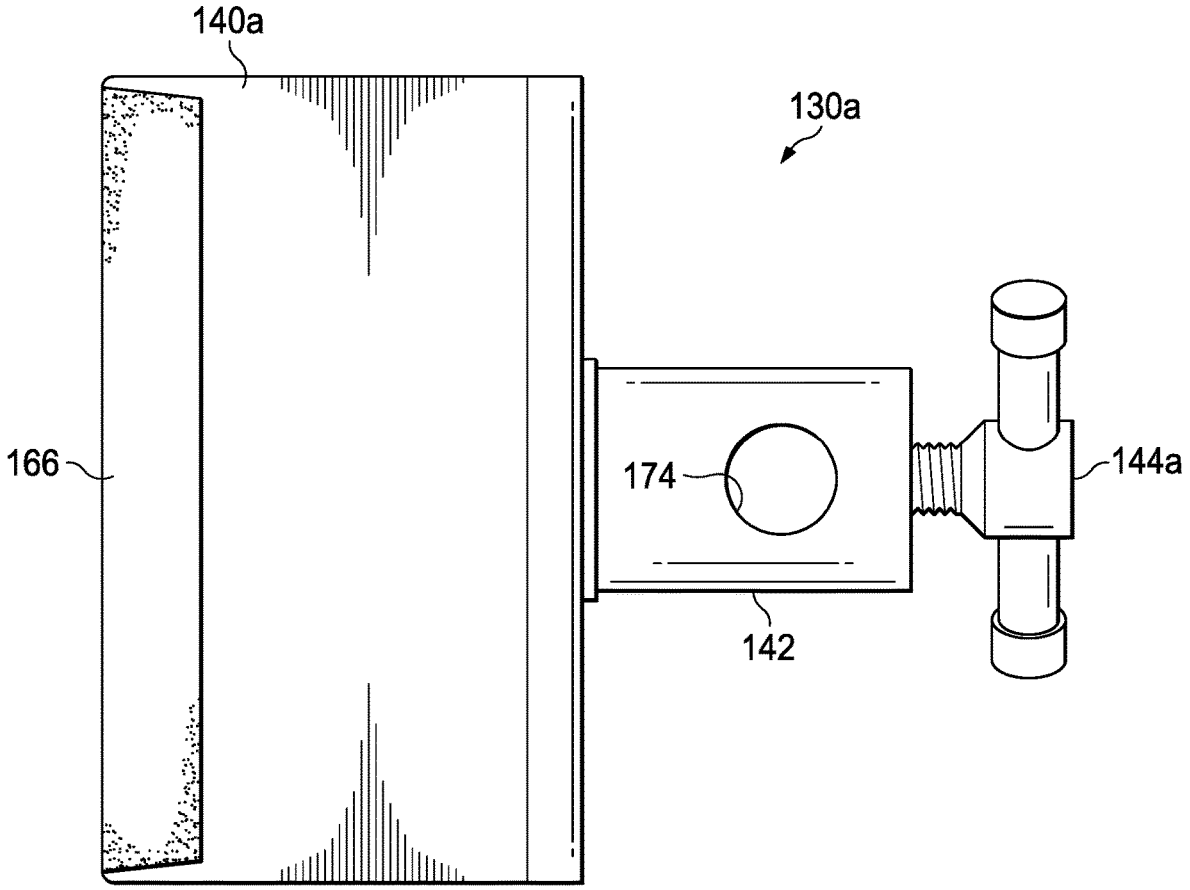
FIG. 15 is a simplified side view diagram of a portion of a cocktail drum, in accordance with an embodiment of the present disclosure.
Figure 16:
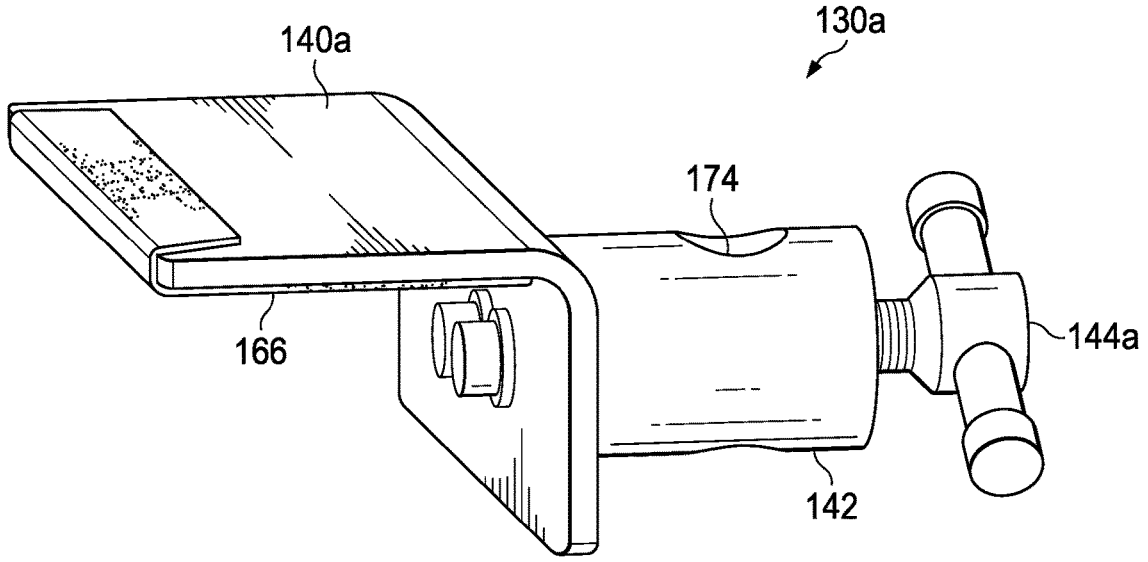
FIG. 16 is a simplified perspective view diagram of a portion of a cocktail drum, in accordance with an embodiment of the present disclosure.
Figure 17:
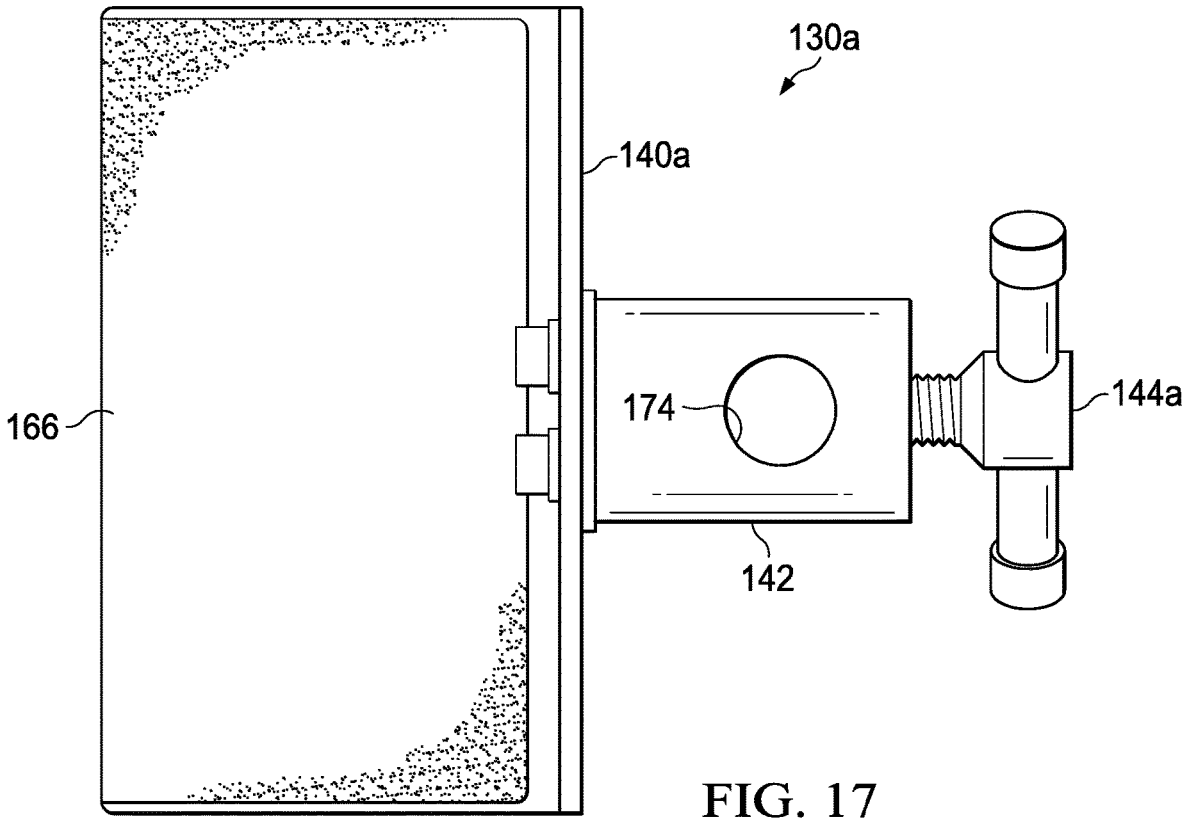
FIG. 17 is a simplified side view diagram of a portion of a cocktail drum, in accordance with an embodiment of the present disclosure.

Turning to FIGS. 15-17, FIGS. 15-17 are a simplified view of a pedal attachment mechanism 130*a*. Pedal attachment mechanism 130*a* can include a leg attachment mechanism 140*a* and support rod attachment mechanism 142. Support rod attachment mechanism 142 can include securing means 144*a* and leg attachment receptacle 174. Leg attachment mechanism 140*a* can include a securing strip 166. Securing strip 166 can be secured on an outside surface of a leg of a drum to help secure pedal attachment mechanism 130*a* to the leg of the drum. In some examples, securing strip 166 is an adhesive or some type of sticky material that can help secure leg attachment mechanism 140*a* to an outside surface of the leg of the drum to help secure pedal attachment mechanism 130*a* to the leg of the drum. In other examples, securing strip 166 may include a hook and loop material (e.g., Velcro®) or some other similar material that allows leg attachment mechanism 140*a* to stick to a mating hook and loop material on the leg of the drum to help secure pedal attachment mechanism 130*a* to the leg of the drum. In yet other examples, securing strip 166 may include buttons, snaps, or some other material that allows securing strip 166 to couple with a mating material on the leg of the drum to help secure pedal attachment mechanism 130*a* to the leg of the drum.

Figure 18:
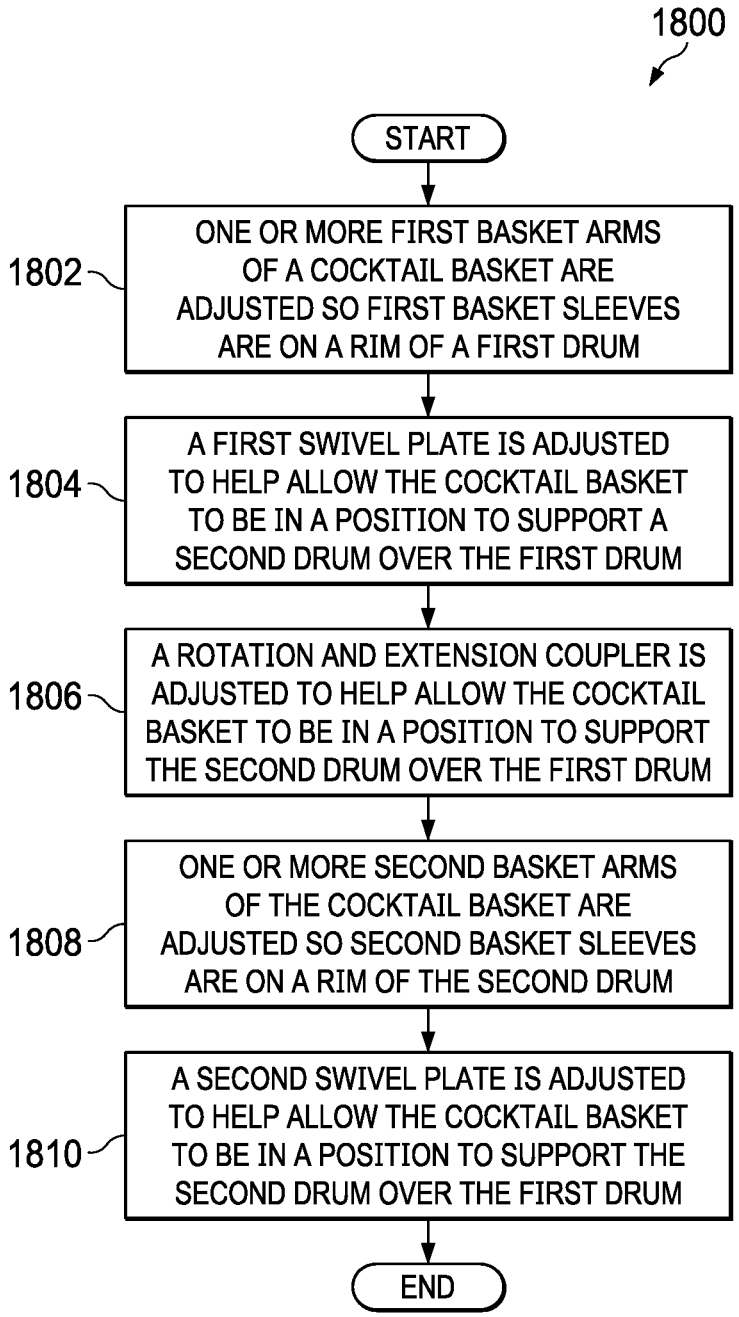
FIG. 18 is a simplified flowchart illustrating potential operations that may be associated with the system in accordance with an embodiment.

Turning to FIG. 18, FIG. 18 is an example flowchart illustrating possible operations of a flow 1800 that may be associated with a cocktail drum, in accordance with an embodiment. At 1802, one or more first basket arms of a cocktail basket are adjusted so first basket sleeves are on a rim of a first drum. At 1804, a first swivel plate is adjusted to help allow the cocktail basket to be in a position to support a second drum over the first drum. At 1806, a rotation and extension coupler is adjusted to help allow the cocktail basket to be in a position to support the second drum over the first drum. At 1808, one or more second basket arms of the cocktail basket are adjusted so second basket sleeves are on a rim of the second drum. At 1810, a second swivel plate is adjusted to help allow the cocktail basset to be in a position to support the second drum over the first drum.

It is to be understood that other embodiments may be utilized and structural changes may be made without departing from the scope of the present disclosure. Substantial flexibility is provided by cocktail drum kit 100 and cocktail basket 110 in that any suitable arrangements and configuration may be provided without departing from the teachings of the present disclosure. Elements of the figures may be coupled to one another through one or more attachment means employing any suitable coupling and/or connections. Additionally, any one or more of these elements of the figures may be combined or removed from the architecture based on particular configuration needs.

It is also important to note that the operations in the preceding diagrams illustrates only some of the possible correlating scenarios and patterns that may be executed. Some of these operations may be deleted or removed where appropriate, or these operations may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided in that any suitable arrangements, chronologies, configurations, and timing mechanisms may be provided without departing from the teachings of the present disclosure.

Although the present disclosure has been described in detail with reference to particular arrangements and configurations, these example configurations and arrangements may be changed significantly without departing from the scope of the present disclosure. Moreover, certain components may be combined, separated, eliminated, or added based on particular needs and implementations. Additionally, although cocktail drum kit 100 and cocktail basket 110 have been illustrated with reference to particular elements and operations that facilitate the cocktail drum, these elements and operations may be replaced by any suitable configuration, architecture, and/or processes that achieve the intended functionality of cocktail drum kit 100 and/or drum cocktail basket 110.

Numerous other changes, substitutions, variations, alterations, and modifications may be ascertained to one skilled in the art and it is intended that the present disclosure encompass all such changes, substitutions, variations, alterations, and modifications as falling within the scope of this application. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

OTHER NOTES AND EXAMPLES

Example A1, is cocktail drum basket for a cocktail drum, the cocktail drum basket including a lower cocktail basket portion, where the lower cocktail basket portion is supported by a rim of a first drum and an upper cocktail basket portion, where the upper cocktail basket portion supports a second drum over the first drum.

In Example A2, the subject matter of Example A1 can optionally include where the lower cocktail basket portion includes a plurality of first basket arms, a plurality of first basket sleeves, a first basket plate, and a first swivel plate.

In Example A3, the subject matter of any one of Examples A1-A2 can optionally include where the upper cocktail basket portion includes a plurality of second basket arms, a plurality of second basket sleeves, a second basket plate, and a second swivel plate.

In Example A4, the subject matter of any one of Examples A1-A3 can optionally include where the lower cocktail basket portion and the upper cocktail basket portion are mirror images of each other.

In Example A5, the subject matter of any one of Examples A1-A4 can optionally include where the lower cocktail basket portion and the upper cocktail basket portion are coupled together using a rotation and extension coupler.

In Example A6, the subject matter of any one of Examples A1-A5 can optionally include where the rotation and extension coupler can rotate the upper cocktail basket portion relative to the lower cocktail basket portion and fix a location of the upper cocktail basket portion relative to the lower cocktail basket portion.

In Example A7, the subject matter of any one of Examples A1-A6 can optionally include where the rotation and extension coupler can allow the lower cocktail basket portion and the upper cocktail basket portion to move towards and away from each other and to fix a location of the upper cocktail basket portion relative to the lower cocktail basket portion.

Example M1 is a method including positioning a second drum over a first drum in a three-dimensional (3D) plane using a cocktail basket to position the second drum along an X-axis, a Y-axis, and a Z-axis. The cocktail basket includes a lower cocktail basket portion, where the lower cocktail basket portion is supported by a rim of a first drum and an upper cocktail basket portion, where the cocktail basket supports a second drum over the first drum.

In Example M2, the subject matter of Example M1 can optionally include where the lower cocktail basket portion includes a plurality of first basket arms, a plurality of first basket sleeves, a first basket plate, and a first swivel plate.

In Example M3, the subject matter of any one of the Examples M1-M2 can optionally include where the upper cocktail basket portion includes a plurality of second basket arms, a plurality of second basket sleeves, a second basket plate, and a second swivel plate.

In Example M4, the subject matter of any one of the Examples M1-M3 can optionally include where the lower cocktail basket portion and the upper cocktail basket portion are mirror images of each other.

In Example M5, the subject matter of any one of the Examples M1-M4 can optionally include where the lower cocktail basket portion and the upper cocktail basket portion are coupled together using a rotation and extension coupler.

In Example M6, the subject matter of any one of the Examples M1-M5 can optionally include where the rotation and extension coupler can rotate the upper cocktail basket portion relative to the lower cocktail basket portion and fix a location of the upper cocktail basket portion relative to the lower cocktail basket portion.

Example AA1 is a system for creating a cocktail drum kit, the system including a floor tom drum, a snare drum, and a cocktail basket. The cocktail basket includes a lower cocktail basket portion, where the lower cocktail basket portion is supported by a rim of the floor tom drum and an upper cocktail basket portion, where the cocktail basket supports the snare drum over the floor tom drum.

In Example AA2, the subject matter of Example AA1 can optionally include where the lower cocktail basket portion includes a plurality of first basket arms, a plurality of first basket sleeves, a first basket plate, and a first swivel plate.

In Example AA3, the subject matter of any one of the Examples AA1-AA2 can optionally include where the upper cocktail basket portion includes a plurality of second basket arms, a plurality of second basket sleeves, a second basket plate, and a second swivel plate.

In Example AA4, the subject matter of any one of the Examples AA1-AA3 can optionally include where the lower cocktail basket portion and the upper cocktail basket portion are mirror images of each other.

In Example AA5, the subject matter of any one of the Examples AA1-AA4 can optionally include where the lower cocktail basket portion and the upper cocktail basket portion are coupled together using a rotation and extension coupler.

In Example AA6, the subject matter of any one of the Examples AA1-AA5 can optionally include where the rotation and extension coupler can rotate the upper cocktail basket portion relative to the lower cocktail basket portion and to fix a location of the upper cocktail basket portion relative to the lower cocktail basket portion.

In Example AA7, the subject matter of any one of the Examples AA1-AA6 can optionally include where the rotation and extension coupler can allow lower cocktail basket portion and upper cocktail basket portion to move towards and away from each other and to fix a location of the upper cocktail basket portion relative to the lower cocktail basket portion.

What is claimed is:

1. A cocktail drum basket for a cocktail drum, the cocktail drum basket comprising:

a lower cocktail basket portion, wherein the lower cocktail basket portion is supported by a rim of a first drum; and an upper cocktail basket portion, wherein the upper cocktail basket portion supports a second drum over the first drum.

2. The cocktail drum basket of claim 1, wherein the lower cocktail basket portion includes:

a plurality of first basket arms;

a plurality of first basket sleeves;

a first basket plate; and a first swivel plate.

3. The cocktail drum basket of claim 1, wherein the upper cocktail basket portion includes:

a plurality of second basket arms;

a plurality of second basket sleeves;

a second basket plate; and a second swivel plate.

4. The cocktail drum basket of claim 1, wherein the lower cocktail basket portion and the upper cocktail basket portion are mirror images of each other.

5. The cocktail drum basket of claim 1, wherein the lower cocktail basket portion and the upper cocktail basket portion are coupled together using a rotation and extension coupler.

6. The cocktail drum basket of claim 5, wherein the rotation and extension coupler rotates the upper cocktail basket portion relative to the lower cocktail basket portion and fixes a location of the upper cocktail basket portion relative to the lower cocktail basket portion.

7. The cocktail drum basket of claim 5, wherein the rotation and extension coupler allows the lower cocktail basket portion and the upper cocktail basket portion to move towards and away from each other and secures the upper cocktail basket portion to a specific location relative to the lower cocktail basket portion.

8. A method comprising:

positioning a second drum over a first drum in a three-dimensional (3D) plane using a cocktail basket to position the second drum along an X-axis, a Y-axis, and a Z-axis, wherein the cocktail basket includes:

a lower cocktail basket portion, wherein the lower cocktail basket portion is supported by a rim of the first drum; and an upper cocktail basket portion, wherein the cocktail basket supports the second drum over the first drum.

9. The method of claim 8, wherein the lower cocktail basket portion includes:

a plurality of first basket arms;

a plurality of first basket sleeves;

a first basket plate; and a first swivel plate.

10. The method of claim 8, wherein the upper cocktail basket portion includes:

a plurality of second basket arms;

a plurality of second basket sleeves;

a second basket plate; and a second swivel plate.

11. The method of claim 8, wherein the lower cocktail basket portion and the upper cocktail basket portion are mirror images of each other.

12. The method of claim 8, wherein the lower cocktail basket portion and the upper cocktail basket portion are coupled together using a rotation and extension coupler.

13. The method of claim 12, wherein the rotation and extension coupler rotates the upper cocktail basket portion relative to the lower cocktail basket portion and fixes a location of the upper cocktail basket portion relative to the lower cocktail basket portion.

14. A system for creating a cocktail drum kit, the system comprising:

a floor tom drum;

a snare drum; and a cocktail basket, wherein the cocktail basket includes:

a lower cocktail basket portion, wherein the lower cocktail basket portion is supported by a rim of the floor tom drum; and an upper cocktail basket portion, wherein the cocktail basket supports the snare drum over the floor tom drum.

15. The system of claim 14, wherein the lower cocktail basket portion includes:

a plurality of first basket arms;

a plurality of first basket sleeves;

a first basket plate; and a first swivel plate.

16. The system of claim 14, wherein the upper cocktail basket portion includes:

a plurality of second basket arms;

a plurality of second basket sleeves;

a second basket plate; and a second swivel plate.

17. The system of claim 14, wherein the lower cocktail basket portion and the upper cocktail basket portion are mirror images of each other.

18. The system of claim 14, wherein the lower cocktail basket portion and the upper cocktail basket portion are coupled together using a rotation and extension coupler.

19. The system of claim 18, wherein the rotation and extension coupler rotates the upper cocktail basket portion relative to the lower cocktail basket portion and to fixes a location of the upper cocktail basket portion relative to the lower cocktail basket portion.

20. The system of claim 18, wherein the rotation and extension coupler allows the lower cocktail basket portion and the upper cocktail basket portion to move towards and away from each other and secures the upper cocktail basket portion to a specific location relative to the lower cocktail basket portion.

* * * * *